US011211179B2

(12) United States Patent
Chae et al.

(10) Patent No.: US 11,211,179 B2
(45) Date of Patent: Dec. 28, 2021

(54) DRYING SPENT NUCLEAR FUEL BASED ON EVALUATION OF DRYING CHARACTERISTICS OBTAINED USING GAS SPECTROSCOPY

(71) Applicant: SAE-AN ENGINEERING CORPORATION, Seoul (KR)

(72) Inventors: Gyung Sun Chae, Gyeonggi-do (KR); Kyoung Uk Shin, Gwangju (KR); Geon Hui Lee, Seoul (KR); Do Yeong Jung, Seoul (KR); Jae Seok Park, Seoul (KR)

(73) Assignee: SAE-AN ENGINEERING CORPORATION, Seoul (KR)

( * ) Notice: Subject to any disclaimer, the term of this patent is extended or adjusted under 35 U.S.C. 154(b) by 0 days.

(21) Appl. No.: 16/804,187

(22) Filed: Feb. 28, 2020

(65) Prior Publication Data

US 2020/0286638 A1 Sep. 10, 2020

(30) Foreign Application Priority Data

Mar. 5, 2019 (KR) ..... 10-2019-0025164

(51) Int. Cl.

| | |
|---|---|
| ***G21F 5/008*** | (2006.01) |
| ***F26B 21/14*** | (2006.01) |
| ***G21F 5/06*** | (2006.01) |
| *G21C 19/32* | (2006.01) |
| *G21F 9/28* | (2006.01) |
| *F26B 3/06* | (2006.01) |

(52) U.S. Cl.

CPC ..... *G21F 5/008* (2013.01); *F26B 21/14* (2013.01); *G21F 5/06* (2013.01); *F26B 3/06* (2013.01); *G21C 19/32* (2013.01); *G21F 9/28* (2013.01)

(58) Field of Classification Search

CPC ... G21F 5/008; G21F 5/06; G21F 9/28; F26B 21/14; F26B 3/06; G21C 19/32

USPC ..... 376/272, 308

See application file for complete search history.

(56) References Cited

U.S. PATENT DOCUMENTS

| | | | | |
|---|---|---|---|---|
| 9,117,558 | B1 * | 8/2015 | Pennington | G21F 5/10 |
| 2005/0066541 | A1 | 3/2005 | Singh | |
| 2006/0272175 | A1 | 12/2006 | Singh | |
| 2006/0288607 | A1 | 12/2006 | Singh | |
| 2008/0056935 | A1 | 3/2008 | Singh | |
| 2010/0212182 | A1 | 8/2010 | Singh | |

(Continued)

FOREIGN PATENT DOCUMENTS

| | | | |
|---|---|---|---|
| KR | 10-0840809 | B1 | 6/2008 |
| KR | 10-1000883 | B1 | 12/2010 |

(Continued)

OTHER PUBLICATIONS

Gyung-Sun Chae et al., "Preliminary Design of the Forced Gas Drying System for Spent Nuclear Fuel Dry Storage", JNFCWT, Dec. 2017, vol. 15, No. 4, pp. 403-409.

*Primary Examiner* — Jack W Keith
*Assistant Examiner* — Daniel Wasil
(74) *Attorney, Agent, or Firm* — IP Legal Services, LLC

(57) ABSTRACT

Apparatus and method for drying spent nuclear fuel loaded in a cavity of a canister. A non-reactive gas discharged from the canister is selectively circulated through one of a contaminated circulation system and a non-contaminated circulation system according to a measured radiation dose rate.

4 Claims, 6 Drawing Sheets

(56) References Cited

U.S. PATENT DOCUMENTS

| | | | | |
|---|---|---|---|---|
| 2013/0163710 | A1 | 6/2013 | Singh | |
| 2014/0047733 | A1* | 2/2014 | Singh | G21C 19/32 34/443 |
| 2014/0317952 | A1 | 10/2014 | Singh | |
| 2018/0053574 | A1 | 2/2018 | Singh | |
| 2019/0353801 | A1 | 11/2019 | Chae et al. | |

FOREIGN PATENT DOCUMENTS

| | | | |
|---|---|---|---|
| KR | 10-1749089 | B1 | 7/2017 |
| KR | 10-1774801 | B1 | 9/2017 |
| KR | 10-1911918 | B1 | 10/2018 |
| KR | 10-1959790 | B1 | 3/2019 |

* cited by examiner

DRYING SPENT NUCLEAR FUEL BASED ON EVALUATION OF DRYING CHARACTERISTICS OBTAINED USING GAS SPECTROSCOPY

CROSS REFERENCE TO PRIOR APPLICATIONS

The present application claims priority under 35 U.S.C. § 119 to Korean Patent Application No. 10-2019-0025164 (filed on Mar. 5, 2019).

BACKGROUND OF THE INVENTION

Field of the Invention

The present invention relates to an apparatus for drying a spent nuclear fuel and a control method thereof, and more particularly, to an apparatus for drying a spent nuclear fuel based on evaluation of drying characteristics obtained from gas spectroscopy in a drying operation technology of removing moisture from a spent nuclear fuel cladding and a canister (storage container) to store the spent nuclear fuel in a dry state, in which a parameter of drying operation characteristic is extracted from a signal outputted from a gas spectroscopy that directly measures a hot non-reactive gas discharged from a gas outlet port of the canister loaded with a spent nuclear fuel, the signal is inputted as a parameter value for drying operation to execute the drying operation, and if the signal outputted from the gas spectroscopy is below a preset value, it is determined the drying of the canister is completed, so that the drying operation is over, and a control method thereof.

Background of the Related Art

In general, storage, handling and transfer of spent nuclear fuels requires special care and procedural safeguards. A hollow zircaloy cladding filled with enriched uranium which is widely known as a fuel assembly is burned in a core of a nuclear reactor. The fuel assembly is generally removed from the nuclear reactor after energy is reduced by a given level. The spent nuclear fuel removed from the core is still high radioactive, and is continuously producing a significant amount of heat. For this reason, the spent nuclear fuel requires special attention at packaging, transportation and storage thereof. Specifically, the spent nuclear fuel emits extremely dangerous neutrons and gamma photons which are harmful to human body. Therefore, after the spent nuclear fuel is removed from the core, the neutrons and the gamma photons should be always shielded.

The spent nuclear fuel used for nuclear power generation is stored in a spent nuclear fuel storage (referred to as a storage pool) by a wet storage method, and the water of the storage pool facilitates cooling of the spent nuclear fuel, and provides adequate radiation shielding. The spent nuclear fuel is stored in the storage pool for a long period of time, for example, 5 to 10 years, enough to allow decay of heat and radiation to a sufficiently low level which can safely transport the spent nuclear fuel. Because of safety, spatial and economical reasons, the spent nuclear fuel cannot be stored in the storage pool for the long time. Thus, it is a standard practice in the nuclear industry to store the spent nuclear fuel in a dry state subsequent to a brief storage period in the storage pool, i.e., storing the spent nuclear fuel in a dry inert gas atmosphere encased within a structure that provides adequate radiation shielding. One typical structure for storing the spent nuclear fuel in the dry state for a long time is a storage cask.

Before the spent nuclear fuel is removed from the core of the nuclear reactor, an open canister is placed on a bottom of a used fuel pool in order to transport the spent nuclear fuel to the storage cask. While the spent nuclear fuel is placed under water, it is directly disposed in the open canister. However, the radiation of the spent nuclear fuel is not properly shielded by only the canister, after the canister is sealed. The canister loaded with the spent nuclear fuel cannot be removed or transported from the used fuel pool, without using additional radiation shield. For this reason, apparatuses and methods for providing additional radiation shield have been proposed to transport the spent nuclear fuel. The additional radiation shield is achieved by disposing the canister in a large cylindrical container which is called as a transport canister. Similar to the storage canister, the transport canister has a cavity of a proper size to receive the canister loaded with the spent nuclear fuel therein, and is designed to shield the radiation emitted from the spent nuclear fuel.

In the equipment for transporting the canister loaded with the spent nuclear fuel by the transport cask, an empty canister is first placed into a cavity of the open cask, and the canister and the cask are disposed in the used fuel pool. Before that, the spent nuclear fuel disposed in the storage apparatus which is removed from the nuclear reactor and is filled with the water is moved to the sunk canister (which is disposed in the transport cask and is filled with the water). The loaded canister is fitted with a lid, and then, the loaded canister and the transport cask are moved from the pool by a crane, and then are loaded at a collection zone in order to transport the canister loaded with the spent nuclear fuel in the dry state. In order for the canister loaded with the spent nuclear fuel to be properly prepared for dry storage or transportation for long periods of time, the United States Nuclear Regulatory Commission (referred to as U.S. NRC) requires that the spent nuclear fuel and interior of the canister be adequately dried before the canister is sealed and transferred to the cask. Specifically, U.S. NRC regulations mandate that vapor pressure within the canister be at or below 3 Torr (1 Torr=1 mmHg) before the canister is backfilled with an inert gas and sealed. The vapor pressure is the pressure of the vapor over a liquid at equilibrium, wherein equilibrium is defined as that condition where an equal number of molecules are transforming from the liquid phase to gas phase as there are molecules transforming from the gas phase to liquid phase. Requiring a low vapor pressure of 3 Torr or less assures an adequately dry space in the canister interior suitable for long-term spent nuclear fuel storage or transportation.

Currently, nuclear facilities comply with the 3 Torr or less vapor pressure requirement of U.S. NRC by performing a vacuum drying process. In performing this process, the bulk water that is within the canister is first drained from the canister. Once the bulk of the liquid water is drained, a vacuum system is coupled to the canister and activated so as to create a sub-atmospheric pressure condition within the canister. The sub-atmospheric condition within the canister facilitates evaporation of the remaining liquid water while the vacuum helps remove the water vapor. The vapor pressure within the canister is empirically ascertained through a vacuum-and-hold procedure. If necessary, the vacuum-and-hold procedure is repeated until the pressure rise during a prescribed test duration (30 minutes) is limited to 3 Torr. Once the vacuum drying passes the acceptance test, the canister is backfilled with an inert gas and the canister is sealed. The transfer cask (with the canister therein) is then transported to a position above a storage cask and the canister loaded with the spent nuclear fuel is transferred into the storage for long-term storage.

Current methods of satisfying the above 3 Torr or less vapor pressure requirement of U.S. NRC are time consuming, manually intensive and prone to error from line and valve leakages. Any time the canister must be physically approached for vacuum monitoring and dryness testing, there is the risk of exposing the work personnel to high radiation. Moreover, the creation of sub-atmospheric conditions in the canister requires expensive vacuum equipment and can cause complicated equipment problems.

In order to solve the above problem, one technology has been proposed in Korean Patent No. 10-1000883 (filed on Jun. 6, 2006, and registered on Dec. 7, 2010), entitled "Method and apparatus for dehydrating high level waste based on dew point temperature measurements", which is assigned to Holtec International.

The configuration of the patent will now be described in brief. There is provided a method of preparing spent nuclear fuel for dry storage drying including the steps of: a) flowing a non-reactive gas through the cavity; b) repetitively measuring dew point temperature of the non-reactive gas exiting the cavity; and c) upon the dew point temperature of the non-reactive gas exiting the cavity being measured to be at or below a predetermined dew point temperature for a predetermined time, discontinuing the flow of the non-reactive gas and sealing the cavity. Also, there is provided a system for drying a cavity loaded with spent nuclear fuel including: a canister forming the cavity, the cavity having an inlet and an outlet; a source of non-reactive gas; means for flowing the non-reactive gas from the source of non-reactive gas through the cavity; and means for repetitively measuring the dew point temperature of the non-reactive gas exiting the cavity; and a controller operably coupled to the dew point temperature measuring means, wherein the dew point temperature measuring means is adapted to create signals indicative of the measured dew point temperature of the non-reactive gas and transmit the signals to the controller; and wherein the controller is adapted to analyze the signals and upon determining that the signals indicate that the measured dew point temperature is at or below a predetermined dew point temperature for a predetermined time, the controller is further adapted to (i) cease flow of the non-reactive gas through the cavity; and/or (ii) activate a means for indicating that the cavity is dry.

The patent measures dew-point temperature to evaluate the suitability of the dry for the canister. In the case where the cavity structure of the canister is complicated, a dry gas is hardly circulated by 25 to 50 times an hour due to the volume of the canister. Also, it is hard to directly measure the dew-point temperature of the hot non-reactive gas which is discharged from an outlet port of the canister. In addition, since the measured result may be varied in the range of the dew-point temperature, i.e., 20 to 26° F., depending upon a measuring position and the operating state of incident equipment, such as a dehumidifier, a separate cooling unit for measuring the dew-point temperature and a circulation loop are required, thereby making a measuring method and apparatus become complex, and lowering the accuracy of the measured value. Since the device for measuring the dew-point temperature comes into direct contact with the non-reactive gas at drying the damaged spent nuclear fuel, the device is polluted by the radioactive substance. Also, a drying time is increased according to the volume of the canister and the cavity structure of the canister. In addition, since a worker is at risk for radiation exposure due to long stays on the site.

The inventors have made several attempts to solve the above-described problems. One example of the attempts is disclosed in Korean Patent Application No. 10-2018-0142673 (filed on Nov. 19, 2018), entitled "Method for evaluating suitability of dry by gas spectroscopy to store spent nuclear fuel in dry state, and drying apparatus thereof." The apparatus includes a non-contaminated circulation system and a contaminated circulation system to execute a process of drying the canister loaded with the spent nuclear fuel. A radiation dose rate is measured at an initial stage of the drying process, and the canister loaded with the normal spent nuclear fuel is subjected to the drying process by the non-contaminated circulation system, while the canister loaded with the damaged spent nuclear fuel is subjected to the drying process by the contaminated circulation system, thereby preventing the drying apparatus from being polluted by the damaged spent nuclear fuel.

Also, another example is disclosed in Korean Patent No. 10-1774801 (registered on Aug. 30, 2017), entitled "Drying method for drying apparatus to transport and store spent nuclear fuel, and control method thereof." The technology measures the radiation dose rate of the non-reactive gas which is discharged from the outlet port of the canister to determine whether or not the canister is polluted. The process of drying the canister is executed by changing a circulation path of the non-reactive gas depending upon the contaminated or non-contaminated canister.

PATENT LITERATURES

Patent Document 1: Korean Patent No.: 10-1000883 (Dec. 7, 2010)

Patent Document 2: Korean Patent No. 10-1774801 (Aug. 30, 2017),

SUMMARY OF THE INVENTION

Therefore, one object of the invention is to provide an apparatus for drying a spent nuclear fuel based on evaluation of drying characteristics obtained from gas spectroscopy, in which the apparatus automatically evaluates suitability of drying for a canister to be dried by use of gas spectroscopy at a process of drying the canister to check achievement of quick drying target, obtain an optimum dry state, quickly and accurately determine whether or not the canister is contaminated by a damaged spent nuclear fuel, and execute the process of drying the canister by selectively circulating a non-reactive gas along a non-contaminated circulation system or a contaminated circulation system, thereby preventing the apparatus from being polluted by the radiation which is caused from the damaged spent nuclear fuel, and also minimizing a worker from being exposed to the radiation by automatically controlling the drying process.

Also, another object of the invention is to provide a method for controlling an apparatus for drying a spent nuclear fuel based on evaluation of drying characteristics obtained from gas spectroscopy.

According to one aspect of the invention, there is provided an apparatus for drying a spent nuclear fuel that dries a cavity of a canister loaded with a spent nuclear fuel, the spent nuclear fuel and a spent nuclear fuel cladding by selectively circulating a non-reactive gas discharged from the canister through a contaminated circulation system or a non-contaminated circulation system according to a contaminated or non-contaminated state, the apparatus including: the canister having the cavity provided with a gas inlet port and a gas outlet port; a non-reactive gas source which is configured to store the non-reactive gas to be supplied to the cavity of the canister; a first gas circulation pump which is mounted on a first gas circulation line which fluidly connects the gas inlet port of the canister and the non-reactive gas source, to feed the non-reactive gas supplied from the non-reactive gas source to the canister; a valve member which is mounted on the first gas circulation line between the first gas circulation pump and the canister to open or close the first gas circulation line; a heater which is mounted on the first gas circulation line between the valve member and the canister to heat the non-reactive gas to be supplied to the canister; a gas cooling unit which is fluidly coupled to the canister through a second gas circulation line to cool the non-reactive gas discharged from the cavity of the canister; a second gas circulation pump which is mounted on a third gas circulation line to feed the non-reactive gas, which passes through the gas cooling unit, to the non-reactive gas source; a fourth gas circulation line which is branched from the second gas circulation line, to fluidly connect the gas cooling unit and the canister, separately from the second gas circulation line, thereby transferring a contaminated non-reactive gas, which is discharged from the canister, to the gas cooling unit; a branched valve member which is mounted on a branched point, from which the second and fourth gas circulation lines are branched, to selectively open or close the second or fourth gas circulation line; a fifth gas circulation line which is fluidly coupled to the fourth gas circulation line to fluidly connect the gas cooling unit and the non-reactive gas source; a particle filter which is mounted on the fifth gas circulation line to remove radioactive particles contained in the contaminated non-reactive gas which is transferred along the fifth gas circulation line after the non-reactive gas passes through the gas cooling unit along the fourth gas circulation line to be cooled; a third gas circulation pump which is mounted on the fifth gas circulation line to feed the non-reactive gas, which is cooled by the gas cooling unit and is free of the radioactive particles through the particle filter, to the non-reactive gas source; a radiation dosimeter which is installed outside the second gas circulation line between the canister and the branched valve member to measure a radiation dose rate of the non-reactive gas which is discharged from the canister and is transferred along the second gas circulation line, and to send a measured signal; a controller which is electrically connected to the first to third gas circulation pumps, the branched valve member and the radiation dosimeter, respectively, to determine pollution of the non-reactive gas discharged from the canister based on the measured signal on the radiation dose rate which is received from the radiation dosimeter, and to control an operating state of the branched valve member and the first to third gas circulation pumps; a measuring block which is mounted on the gas outlet port of the canister, and has a transparent window; a gas spectroscopy device which irradiates a transmitted laser onto the non-reactive gas discharged from the canister through the transparent window of the measuring block, and receives scattered light from the non-reactive gas to measure a gas spectroscopy signal which is indicative of components of the non-reactive gas and target components to send the measured value; and a temperature measuring member which is mounted on the gas outlet port of the canister to measure a temperature inside the canister, wherein the controller is electrically connected to the gas spectroscopy and the temperature measuring member, and executes drying operation according to the measured values received from the gas spectroscopy and the temperature measuring member to control execution of the drying operation.

The apparatus further includes a sixth gas circulation line which is fluidly coupled to the second gas circulation line between the canister and the branched valve member and also to the third gas circulation line between the gas cooling unit and the second gas circulation pump, to preliminarily circulate a non-contaminated non-reactive gas along the third gas circulation line together with radioactive substance discharged from the gas outlet port of the canister at preliminary operation; a first valve member which is mounted on the second gas circulation line between the branched point of the second gas circulation line and the branched valve member to close the second gas circulation line, thereby interrupting transfer of the non-reactive gas, which is discharged from the gas outlet port of the canister at the preliminary operation, to the gas cooling unit; second and third valve members which are mounted on both ends of the sixth gas circulation line to open or close the sixth gas circulation line so that the non-reactive gas discharged from the gas outlet port of the canister at the preliminary operation flows along the sixth gas circulation line; a seventh gas circulation line which is branched from the sixth gas circulation line and is fluidly coupled to the fifth gas circulation line between the gas cooling unit and the particle filter, to preliminarily circulate the contaminated non-reactive gas along the fifth gas circulation line together with the radioactive substance discharged from the gas outlet port of the canister at the preliminary operation; a fourth valve member which is mounted on the seventh gas circulation line to interrupt an end of the seventh gas circulation line at the fifth gas circulation line so that the non-reactive gas transferred from the gas cooling unit along the fifth gas circulation line flows to the seventh gas circulation line; a fifth valve member which is mounted on the third gas circulation line between the gas cooling unit and the branched point of the sixth gas circulation line to interrupt the third gas circulation line so that the non-reactive gas flowing to the third gas circulation line from the sixth gas circulation line at the preliminary operation flows to the gas cooling unit; a sixth valve member which is mounted on the fifth gas circulation line between the gas cooling unit and the branched point of the seventh gas circulation line to interrupt the fifth gas circulation line so that the non-reactive gas flowing to the fifth gas circulation line from the seventh gas circulation line at the preliminary operation flows to the gas cooling unit; a branched valve member which is mounted on a branched point of the sixth and seventh gas circulation lines to selectively open or close the sixth or seventh gas circulation line; a seventh valve member which is mounted on the third gas circulation line between the second gas circulation pump and the non-reactive gas source to interrupt the third gas circulation line so that the non-reactive gas flowing along the third gas circulation line at the preliminary operation flows to the non-reactive gas source; an eighth valve member which is mounted on the fifth gas circulation line between the third gas circulation pump and the non-reactive gas source to interrupt the fifth gas circulation line so that the non-reactive gas flowing along the fifth gas circulation line at the preliminary operation flows to the non-reactive gas source; an eighth gas circulation line which is fluidly coupled to the third gas circulation line between the second gas circulation pump and the seventh valve member and also to the first gas circulation line between the valve member and the heater, to preliminarily circulate the non-contaminated non-reactive gas along the first gas circulation line together with radioactive substance flowing allowing the third gas circulation line at the preliminary operation; ninth and eleventh valve members which are mounted on both ends of the eighth gas circulation line to open or close the eighth gas circulation line, thereby preventing the non-reactive gas circulating along the first and third gas circulation lines at the drying operation from flowing to the eighth gas circulation line; a ninth gas circulation line which is fluidly coupled to the fifth gas circulation line between the third gas circulation pump and the eighth valve member and also to the eighth gas circulation line between the ninth valve member and the eleventh valve member, to circulate the non-reactive gas, which is flowing along the fifth gas circulation line at the preliminary operation, along the eighth gas circulation line; and a tenth valve member which is mounted on an end of the ninth gas circulation line at a side of the fifth gas circulation line to shut off the ninth gas circulation line, thereby preventing the non-reactive gas circulating along the fifth gas circulation line at the drying operation from flowing to the ninth gas circulation line, wherein the controller is electrically connected to the first to eleventh valve members, the radiation dosimeter, the valve member, the branched valve member, the second and third gas circulation pumps, the heater, the gas spectroscopy device and the temperature measuring member, respectively, and executes the preliminary operation by controlling operation of the first to eleventh valve members, the valve member, the branched valve member, the second and third gas circulation pumps, and the heater, according to a measured indoor temperature value of the canister which is received from the temperature measuring member and the detected value received from the radiation dosimeter at the preliminary operation, to control execution of the drying operation.

Also, according to other aspect of the invention, there is provided, in an apparatus for drying a spent nuclear fuel that dries a cavity of a canister loaded with a spent nuclear fuel, the apparatus including: the canister having the cavity provided with a gas inlet port and a gas outlet port; a non-reactive gas source which is configured to store the non-reactive gas to be supplied to the cavity of the canister; a first gas circulation pump which is mounted on a first gas circulation line which fluidly connects the gas inlet port of the canister and the non-reactive gas source, to feed the non-reactive gas supplied from the non-reactive gas source to the canister; a valve member which is mounted on the first gas circulation line between the first gas circulation pump and the canister to open or close the first gas circulation line; a heater which is mounted on the first gas circulation line between the valve member and the canister to heat the non-reactive gas to be supplied to the canister; a gas cooling unit which is fluidly coupled to the canister through a second gas circulation line to cool the non-reactive gas discharged from the cavity of the canister; a second gas circulation pump which is mounted on a third gas circulation line to feed the non-reactive gas, which passes through the gas cooling unit, to the non-reactive gas source; a fourth gas circulation line which is branched from the second gas circulation line, to fluidly connect the gas cooling unit and the canister, separately from the second gas circulation line, thereby transferring a contaminated non-reactive gas, which is discharged from the canister, to the gas cooling unit; a branched valve member which is mounted on a branched point, from which the second and fourth gas circulation lines are branched, to selectively open or close the second or fourth gas circulation line; a fifth gas circulation line which is fluidly coupled to the fourth gas circulation line to fluidly connect the gas cooling unit and the non-reactive gas source; a particle filter which is mounted on the fifth gas circulation line to remove radioactive particles contained in the contaminated non-reactive gas which is transferred along the fifth gas circulation line after the non-reactive gas passes through the gas cooling unit along the fourth gas circulation line to be cooled; a third gas circulation pump which is mounted on the fifth gas circulation line to feed the non-reactive gas, which is cooled by the gas cooling unit and is free of the radioactive particles through the particle filter, to the non-reactive gas source; a radiation dosimeter which is installed outside the second gas circulation line between the canister and the branched valve member to measure a radiation dose rate of the non-reactive gas which is discharged from the canister and is transferred along the second gas circulation line, and to send a measured signal; a measuring block which is mounted on the gas outlet port of the canister, and has a transparent window; a gas spectroscopy device which irradiates a transmitted laser onto the non-reactive gas discharged from the canister through the transparent window of the measuring block, and receives scattered light from the non-reactive gas to measure a gas spectroscopy signal which is indicative of components of the non-reactive gas and target components to send the measured value; a temperature measuring member which is mounted on the gas outlet port of the canister to measure a temperature inside the canister; and a controller which is electrically connected to the first to third gas circulation pumps, the branched valve member, the radiation dosimeter, the gas spectroscopy and the temperature measuring member, respectively, to determine pollution of the non-reactive gas discharged from the canister based on the measured signal on the radiation dose rate which is received from the radiation dosimeter, and to control an operating state of the branched valve member and the first to third gas circulation pumps, thereby drying the cavity of the canister by selectively circulating the non-reactive gas discharged from the canister through a contaminated circulation system or a non-contaminated circulation system according to a contaminated or non-contaminated state, as well as executing and controlling the preliminary operation and the drying operation according to the measured values received from the gas spectroscopy and the temperature measuring member, a method for controlling the apparatus which dries the spent nuclear fuel based on evaluation of drying characteristics obtained from the gas spectroscopy, the method including: a step (S1000) of setting the dried canister to a gas circulation system so that the non-reactive gas is discharged from the predetermined gas outlet port and is circulated, and inputting a preset temperature value for starting normal drying operation, a preset parameter value for the drying operation, a preset drying reference value, and a preset reference radiation dose rate for determining whether the non-reactive gas is contaminated or not, to prepare the operation; a step (S1100) of feeding the non-reactive gas to the cavity of the canister through the first gas circulation line; a step (S1200) of measuring the temperature of the non-reactive gas discharged from the gas outlet port of the canister by the temperature measuring member after the step (S1100) is completed, and sending the measured value to the controller; a step (S1300) of determining whether or not the initial temperature value of the canister measured at the step (S1200) is above the preset temperature value for starting the normal drying operation; if it is determined at the step (S1300) that the initial temperature value of the canister measured at the step (S1200) is above the preset temperature value for starting the normal drying operation, a step (S1400) of measuring the radiation dose rate of the non-reactive gas which is discharged from the gas outlet port of the canister and is circulated along the second gas circulation line; a step (S1500) of determining whether or not the radiation dose rate of the non-reactive gas measured at the step (S1400) is above a reference radiation dose rate; if it is determined at the step (S1500) that the measured radiation dose rate is above the reference radiation dose rate, a step (S1600) of opening the first, sixth and eighth valve members and opening the branched valve member toward the fourth gas circulation line to form a contaminated circulation system consisting of the first, fourth and fifth gas circulation lines; if the step (S1600) is completed, a step (S1610) of circulating the contaminated non-reactive gas along the contaminated circulation system via the canister, based on the preset parameter value for the drying operation which is inputted at the step (S1000), to dry the cavity of the canister; if it is determined at the step (S1500) that the measured radiation dose rate is less than the reference radiation dose rate, a step (S1700) of opening the first, fifth and seventh valve members and the valve member, and opening the branched valve member toward the second gas circulation line to form a non-contaminated circulation system consisting of the first, second and third gas circulation lines; if the step (S1700) is completed, a step (S1710) of circulating the non-reactive gas along the contaminated circulation system or the non-contaminated circulation system via the canister, based on the preset parameter value for the drying operation which is inputted at the step (S1000), to dry the cavity of the canister; while the step (S1610) or the step (S1710) is executing, a step (S1900) of measuring a target component of the non-reactive gas discharged from the gas outlet port and residual amounts of the target component with the gas spectroscopy which is mounted on the gas outlet port of the canister; a step (S2000) of comparing the measured residual amounts of the target component, which is measured at the step (S1900), with the preset drying reference value, to determine whether or not the measured residual amounts are less than the preset drying reference value; if it is determined at the step (S2000) that the measured residual amounts are above the preset drying reference value, a step (S2100) of computing a parameter for drying operation characteristic corresponding to the measured residual amounts to extract a preset parameter value for the drying operation characteristic; a step (S2200) of inputting the preset parameter value for the drying operation characteristic to control the drying operation, thereby applying the preset parameter value for the drying operation characteristic, which is extracted from the step (S2100), to the steps (S1610 and S1710), and then proceeding to the step (S1610) or the step (S1710); if it is determined at the step (S2000) that the measured residual amounts are less than the preset drying reference value, a step (S2300) of counting a preset time; if the step (S2300) is completed, a step (S2400) of measuring the target component of the non-reactive gas discharged from the gas outlet port and residual amounts of the target component with the gas spectroscopy which is mounted on the gas outlet port of the canister; a step (S2500) of comparing the measured residual amounts of the target component, which is measured at the step (S2400), with the preset drying reference value, to determine whether or not the measured residual amounts are less than the preset drying reference value, and if the measured residual amounts are above the preset drying reference value, proceeding to the step (S1610) or the step (S1710), or if the measured residual amounts are less than the preset drying reference value, completing the drying operation for the canister, wherein the preset temperature value for starting the normal drying operation is in a range of 40 to 70° C., the preset parameter value for the drying operation includes a pumping speed of the pump and a heating value of the heater, the preset parameter value for the drying operation characteristic includes a positive or negative value corresponding to the pumping speed of the pump, and a positive or negative value corresponding to the heating value of the heater, as a parameter for controlling the operation of the pump and the heater corresponding to a parameter of the drying operation, and if the measured residual amounts are more than the preset drying reference value, at the step (S2100), the pumping speed of the pump is extracted as the negative value, and the heating value of the heater is extracted as the positive value.

In addition, according to another aspect of the invention, there is provided, in an apparatus for drying a spent nuclear fuel that dries a cavity of a canister loaded with a spent nuclear fuel, the apparatus including: the canister having the cavity provided with a gas inlet port and a gas outlet port; a non-reactive gas source which is configured to store the non-reactive gas to be supplied to the cavity of the canister; a first gas circulation pump which is mounted on a first gas circulation line which fluidly connects the gas inlet port of the canister and the non-reactive gas source, to feed the non-reactive gas supplied from the non-reactive gas source to the canister; a valve member which is mounted on the first gas circulation line between the first gas circulation pump and the canister to open or close the first gas circulation line; a heater which is mounted on the first gas circulation line between the valve member and the canister to heat the non-reactive gas to be supplied to the canister; a gas cooling unit which is fluidly coupled to the canister through a second gas circulation line to cool the non-reactive gas discharged from the cavity of the canister; a second gas circulation pump which is mounted on a third gas circulation line to feed the non-reactive gas, which passes through the gas cooling unit, to the non-reactive gas source; a fourth gas circulation line which is branched from the second gas circulation line, to fluidly connect the gas cooling unit and the canister, separately from the second gas circulation line, thereby transferring a contaminated non-reactive gas, which is discharged from the canister, to the gas cooling unit; a branched valve member which is mounted on a branched point, from which the second and fourth gas circulation lines are branched, to selectively open or close the second or fourth gas circulation line; a fifth gas circulation line which is fluidly coupled to the fourth gas circulation line to fluidly connect the gas cooling unit and the non-reactive gas source; a particle filter which is mounted on the fifth gas circulation line to remove radioactive particles contained in the contaminated non-reactive gas which is transferred along the fifth gas circulation line after the non-reactive gas passes through the gas cooling unit along the fourth gas circulation line to be cooled; a third gas circulation pump which is mounted on the fifth gas circulation line to feed the non-reactive gas, which is cooled by the gas cooling unit and is free of the radioactive particles through the particle filter, to the non-reactive gas source; a radiation dosimeter which is installed outside the second gas circulation line between the canister and the branched valve member to measure a radiation dose rate of the non-reactive gas which is discharged from the canister and is transferred along the second gas circulation line, and to send a measured signal; a measuring block which is mounted on the gas outlet port of the canister, and has a transparent window; a gas spectroscopy device which irradiates a transmitted laser onto the non-reactive gas discharged from the canister through the transparent window of the measuring block, and receives scattered light from the non-reactive gas to measure a gas spectroscopy signal which is indicative of components of the non-reactive gas and target components to send the measured value; a temperature measuring member which is mounted on the gas outlet port of the canister to measure a temperature inside the canister; a sixth gas circulation line which is fluidly coupled to the second gas circulation line between the canister and the branched valve member and also to the third gas circulation line between the gas cooling unit and the second gas circulation pump, to preliminarily circulate a non-contaminated non-reactive gas along the third gas circulation line together with radioactive substance discharged from the gas outlet port of the canister at preliminary operation; a first valve member which is mounted on the second gas circulation line between the branched point of the second gas circulation line and the branched valve member to close the second gas circulation line, thereby interrupting transfer of the non-reactive gas, which is discharged from the gas outlet port of the canister at the preliminary operation, to the gas cooling unit; second and third valve members which are mounted on both ends of the sixth gas circulation line to open or close the sixth gas circulation line so that the non-reactive gas discharged from the gas outlet port of the canister at the preliminary operation flows along the sixth gas circulation line; a seventh gas circulation line which is branched from the sixth gas circulation line and is fluidly coupled to the fifth gas circulation line between the gas cooling unit and the particle filter, to preliminarily circulate the contaminated non-reactive gas along the fifth gas circulation line together with the radioactive substance discharged from the gas outlet port of the canister at the preliminary operation; a fourth valve member which is mounted on the seventh gas circulation line to interrupt an end of the seventh gas circulation line at the fifth gas circulation line so that the non-reactive gas transferred from the gas cooling unit along the fifth gas circulation line flows to the seventh gas circulation line; a fifth valve member which is mounted on the third gas circulation line between the gas cooling unit and the branched point of the sixth gas circulation line to interrupt the third gas circulation line so that the non-reactive gas flowing to the third gas circulation line from the sixth gas circulation line at the preliminary operation flows to the gas cooling unit; a sixth valve member which is mounted on the fifth gas circulation line between the gas cooling unit and the branched point of the seventh gas circulation line to interrupt the fifth gas circulation line so that the non-reactive gas flowing to the fifth gas circulation line from the seventh gas circulation line at the preliminary operation flows to the gas cooling unit; a branched valve member which is mounted on a branched point of the sixth and seventh gas circulation lines to selectively open or close the sixth or seventh gas circulation line; a seventh valve member which is mounted on the third gas circulation line between the second gas circulation pump and the non-reactive gas source to interrupt the third gas circulation line so that the non-reactive gas flowing along the third gas circulation line at the preliminary operation flows to the non-reactive gas source; an eighth valve member which is mounted on the fifth gas circulation line between the third gas circulation pump and the non-reactive gas source to interrupt the fifth gas circulation line so that the non-reactive gas flowing along the fifth gas circulation line at the preliminary operation flows to the non-reactive gas source; an eighth gas circulation line which is fluidly coupled to the third gas circulation line between the second gas circulation pump and the seventh valve member and also to the first gas circulation line between the valve member and the heater, to preliminarily circulate the non-contaminated non-reactive gas along the first gas circulation line together with radioactive substance flowing allowing the third gas circulation line at the preliminary operation; ninth and eleventh valve members which are mounted on both ends of the eighth gas circulation line to open or close the eighth gas circulation line, thereby preventing the non-reactive gas circulating along the first and third gas circulation lines at the drying operation from flowing to the eighth gas circulation line; a ninth gas circulation line which is fluidly coupled to the fifth gas circulation line between the third gas circulation pump and the eighth valve member and also to the eighth gas circulation line between the ninth valve member and the eleventh valve member, to circulate the non-reactive gas, which is flowing along the fifth gas circulation line at the preliminary operation, along the eighth gas circulation line; a tenth valve member which is mounted on an end of the ninth gas circulation line at a side of the fifth gas circulation line to shut off the ninth gas circulation line, thereby preventing the non-reactive gas circulating along the fifth gas circulation line at the drying operation from flowing to the ninth gas circulation line; and a controller which is electrically connected to the first to third gas circulation pumps, the branched valve member, the radiation dosimeter, the gas spectroscopy, the temperature measuring member, the first to eleventh valve members, the valve member, the second and third gas circulation pumps and the heater, respectively, to determine pollution of the non-reactive gas discharged from the canister based on the measured signal on the radiation dose rate which is received from the radiation dosimeter, and to control an operating state of the branched valve member and the first to third gas circulation pumps according to the determined results and an operating state of the first to eleventh valve members, the valve member, the second and third gas circulation pumps and the heater according to the measured cavity temperature of the canister received from the temperature measuring member and the measured values received from the radiation dosimeter at the preliminary operation, thereby drying the cavity of the canister by selectively circulating the non-reactive gas discharged from the canister through a contaminated circulation system or a non-contaminated circulation system according to a contaminated or non-contaminated state, as well as executing and controlling the preliminary operation and the drying operation according to the measured values received from the gas spectroscopy and the temperature measuring member, a method for controlling the apparatus which dries the spent nuclear fuel based on evaluation of drying characteristics obtained from the gas spectroscopy, the method including: a step (S5000) of setting the dried canister to a gas circulation system so that the non-reactive gas is discharged from the predetermined gas outlet port and is circulated, and inputting a preset temperature value for starting normal drying operation, a preset parameter value for the drying operation, a preset drying reference value, and a preset reference radiation dose rate for determining whether the non-reactive gas is contaminated or not, to prepare the operation; a step (S5100) of feeding the non-reactive gas to the cavity of the canister through the first gas circulation line; a step (S5200) of measuring the temperature of the non-reactive gas discharged from the gas outlet port of the canister by the temperature measuring member after the step (S5100) is completed, and sending the measured value to the controller; a step (S5300) of determining whether or not the initial temperature value of the canister measured at the step (S5200) is above the preset temperature value for starting the normal drying operation; if it is determined at the step (S5300) that the measured initial temperature value of the canister is less than the preset temperature value for starting the normal drying operation, a step (S5400) of closing the valve member, the first, fifth, sixth, seventh and eighth valve members, opening the second and eleventh valve members, and turning on the heater to preheat the canister; if the step (S5400) is completed, a step (S5500) of measuring the radiation dose rate of the cold non-reactive gas which is discharged from the gas outlet port of the canister and is circulated along the sixth gas circulation line; if it is determined at the step (S5300) that the measured initial temperature value of the canister is above the preset temperature value for starting the normal drying operation, a step (S5510) of measuring the radiation dose rate of the non-reactive gas which is discharged from the gas outlet port of the canister and is circulated along the second gas circulation line; a step (S5600) of determining whether or not the radiation dose rate of the cold non-reactive gas measured at the step (S5500) is above a reference radiation dose rate; a step (S5610) of determining whether or not the radiation dose rate of the non-reactive gas of the normal temperature measured at the step (S5510) is above the reference radiation dose rate; if it is determined at the step (S5600) that the measured radiation dose rate is above the reference radiation dose rate, a step (S5700) of opening the branched valve member toward the seventh gas circulation line and opening the fourth and tenth valve members to form a contaminated preheating circulation system consisting of the canister, the seventh, fifth, ninth, eighth and first gas circulation lines; if the step (S5700) is completed, a step (S5800) of turning on the third gas circulation pump to circulate the contaminated cold non-reactive gas along the contaminated preheating circulation system, thereby raising the cavity temperature of the canister by the preset value for the normal drying operation; if it is determined at the step (S5600) that the measured radiation dose rate is less than the reference radiation dose rate, a step (S5900) of opening the branched valve member toward the sixth gas circulation line and opening the third and ninth valve members to form a non-contaminated preheating circulation system consisting of the canister, the sixth, third, eighth first gas circulation lines; if the step (S5900) is completed, a step (S6000) of turning on the third gas circulation pump to circulate the non-contaminated cold non-reactive gas along the non-contaminated preliminary circulation system, so that the cavity temperature of the canister raises up to the preset temperature value for starting the normal drying operation; while the step (S5800) is executing, a step (S6100) of measuring the temperature of the non-reactive gas discharged from the gas outlet port of the canister to measure the cavity temperature of the canister while preheating the contaminated cold non-reactive gas; while the step (S6000) is executing, a step (S6200) of measuring the temperature of the non-reactive gas discharged from the gas outlet port of the canister to measure the cavity temperature of the canister while preheating the non-contaminated non-reactive gas; a step (S6300) of determining whether or not the cavity temperature of the canister measured at the step (S6100) reaches the preset temperature value for starting the normal drying operation, and if the measured cavity temperature of the canister does not reach the preset temperature value for starting the normal drying operation, proceeding to the step (S5800); if it is determined at the step (S6300) that the measured cavity temperature of the canister is more than the preset temperature value for starting the normal drying operation or if it is determined at the step (S5610) that the measured radiation dose rate of the non-reactive gas of the normal temperature is above the reference radiation dose rate, a step (S6400) of opening the branched valve member toward the fourth gas circulation line, opening the valve member, the first, sixth, and eighth valve members, and closing the second, fourth, tenth and eleventh valve members to form a normal contaminated drying circulation system consisting of the canister, the fourth gas circulation line, the gas cooling unit, the fifth gas circulation line, the non-reactive gas source and the first gas circulation line; if the step (S6400) is completed, a step (S6500) of turning on the first and third gas circulation pumps and the gas cooling unit to circulate the contaminated non-reactive gas along the normal contaminated circulation system, based on the preset parameter value for the drying operation which is inputted at the step (S5000), thereby drying the cavity of the canister; a step (S6600) of determining whether or not the cavity temperature of the canister measured at the step reaches the preset temperature value for starting the normal drying operation, and if the measured cavity temperature of the canister does not reach the preset temperature value for starting the normal drying operation, proceeding to the step (S6000); if it is determined at the step (S6600) that the measured cavity temperature of the canister is more than the preset temperature value for starting the normal drying operation or if it is determined at the step (S5610) that the measured radiation dose rate of the non-reactive gas of the normal temperature is less than the reference radiation dose rate, a step (S6700) of opening the branched valve member toward the second gas circulation line, opening the valve member, the first, fifth and seventh valve members, and closing the second, third, ninth and eleventh valve members to form a normal non-contaminated drying circulation system consisting of the canister, the second gas circulation line, the gas cooling unit, the third gas circulation line, the non-reactive gas source and the first gas circulation line; if the step (S6700) is completed, a step (S6800) of turning on the first and second gas circulation pumps and the gas cooling unit to circulate the non-contaminated non-reactive gas along the normal non-contaminated circulation system based on the preset parameter value for the drying operation which is inputted at the step (S5000), thereby drying the non-contaminated cavity of the canister; while the step (S6500) or the step (S6800) is executing, a step (S6900) of measuring a target component of the non-reactive gas discharged from the gas outlet port and residual amounts of the target component with the gas spectroscopy which is mounted on the gas outlet port of the canister; a step (S7000) of comparing the measured residual amounts of the target component, which is measured at the step (S6900), with the preset drying reference value, to determine whether or not the measured residual amounts are less than the preset drying reference value; if it is determined at the step (S7000) that the measured residual amounts are above the preset drying reference value, a step (S7100) of computing a parameter for drying operation characteristic corresponding to the measured residual amounts to extract a preset parameter value for the drying operation characteristic; a step (S7200) of inputting the preset parameter value for the drying operation characteristic to control the operation of the gas circulation system, thereby applying the preset parameter value for the drying operation characteristic, which is extracted from the step (S7100), to the drying operation, and then proceeding to the step (S6900); if it is determined at the step (S7000) that the measured residual amounts are less than the preset drying reference value, a step (S7300) of counting a preset time; if the step (S7300) is completed, a step (S7400) of measuring the target component of the non-reactive gas discharged from the gas outlet port and residual amounts of the target component with the gas spectroscopy which is mounted on the gas outlet port of the canister; a step (S7500) of comparing the measured residual amounts of the target component, which is measured at the step (S7400), with the preset drying reference value, to determine whether or not the measured residual amounts are less than the preset drying reference value, and if the measured residual amounts are more than the preset drying reference value, proceeding to the step (S7100), or if the measured residual amounts are below the preset drying reference value, completing the drying operation for the canister, wherein the preset temperature value for starting the normal drying operation is in a range of 40 to 70°, the preset parameter value for the drying operation includes a pumping speed of the pump and a heating value of the heater, the preset parameter value for the drying operation characteristic includes a positive or negative value corresponding to the pumping speed of the pump, and a positive or negative value corresponding to the heating value of the heater, as a parameter for controlling the operation of the pump and the heater corresponding to a parameter of the drying operation, and if the measured residual amounts are more than the preset drying reference value, at the step (S7100), the pumping speed of the pump is extracted as the negative value, and the heating value of the heater is extracted as the positive value.

With the above configuration, the apparatus automatically evaluates suitability of drying for the canister to be dried by use of gas spectroscopy at the process of drying the canister to check achievement of quick drying target, obtain the optimum dry state, quickly and accurately determine whether or not the canister is contaminated by a damaged spent nuclear fuel, and execute the process of drying the canister by selectively circulating the non-reactive gas along the non-contaminated circulation system or the contaminated circulation system, thereby preventing the apparatus from being polluted by the radiation which is caused from the damaged spent nuclear fuel, and also minimizing the worker from being exposed to the radiation by automatically controlling the drying process.

BRIEF DESCRIPTION OF THE DRAWINGS

Reference is now made briefly to the accompanying drawings, in which.

DETAILED DESCRIPTION OF THE PREFERRED EMBODIMENT

Hereinafter, embodiments of the present invention will be explained in detail in conjunction with the accompanying drawings so that those skilled in the art can easily carry out the present invention. The embodiments of the present invention are intended to be illustrative only. Numerous alternative embodiments may be devised by those skilled in the art without departing from the scope of the following claims.

In the following description, detailed descriptions of well-known functions or constructions will be omitted since they would obscure the invention in unnecessary detail. The terminology used herein is for the purpose of describing particular embodiments only and is not intended to limit the right scope of the invention. Unless otherwise defined, all terms used herein have the same meaning as commonly understood by one of ordinary skill in the art to which this invention pertains, and should not be interpreted as having an excessively comprehensive meaning nor as having an excessively contracted meaning.

Hereinafter, an apparatus for drying a spent nuclear fuel based on evaluation of drying characteristics obtained from gas spectroscopy and a control method thereof according to preferred embodiments of the invention will be described in detail.

Figure 1:
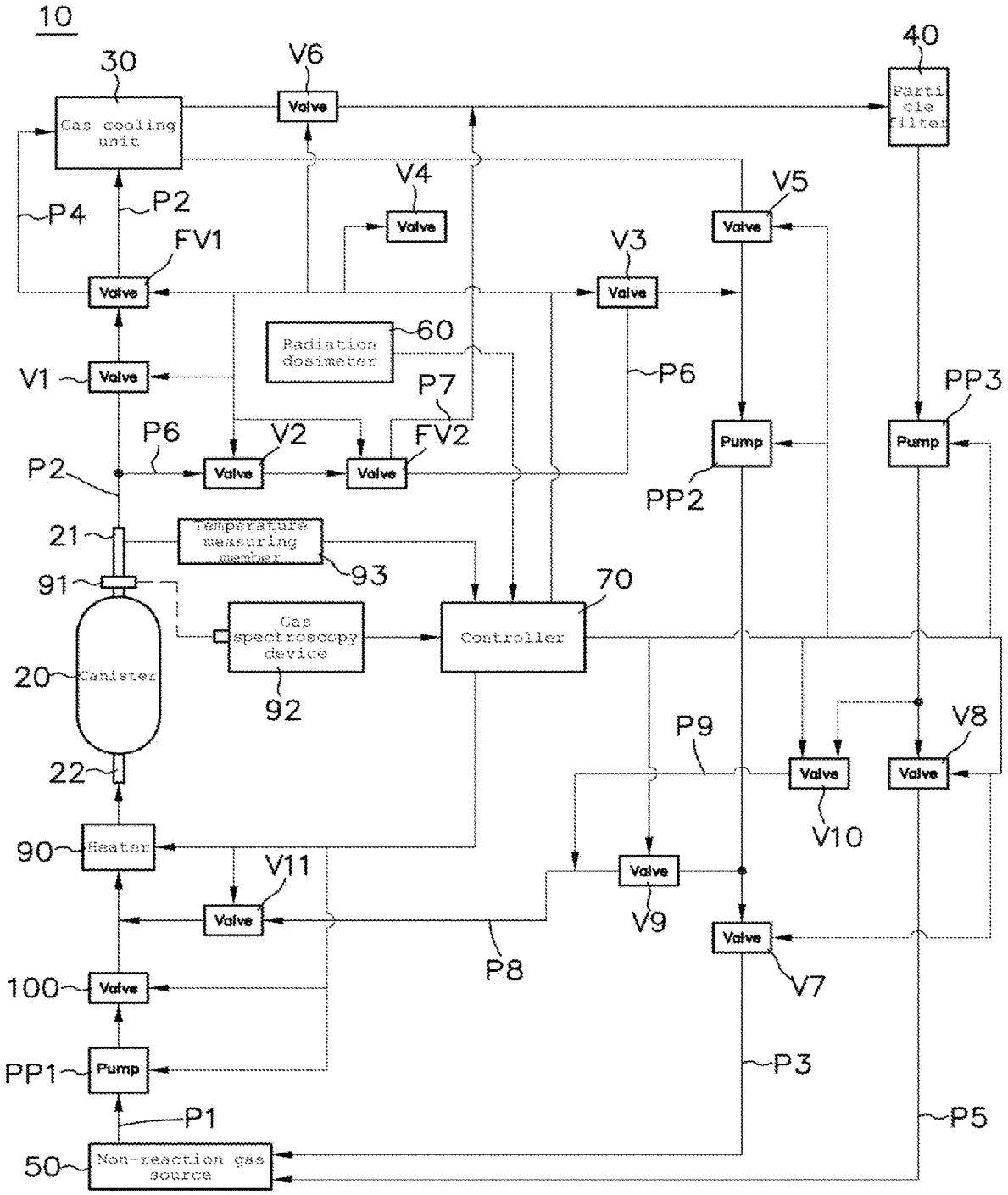
FIG. 1 is a block diagram illustrating the configuration of an apparatus for drying a spent nuclear fuel based on evaluation of drying characteristics obtained from gas spectroscopy according to one embodiment of the invention to show a relationship of components.
Figure 2:
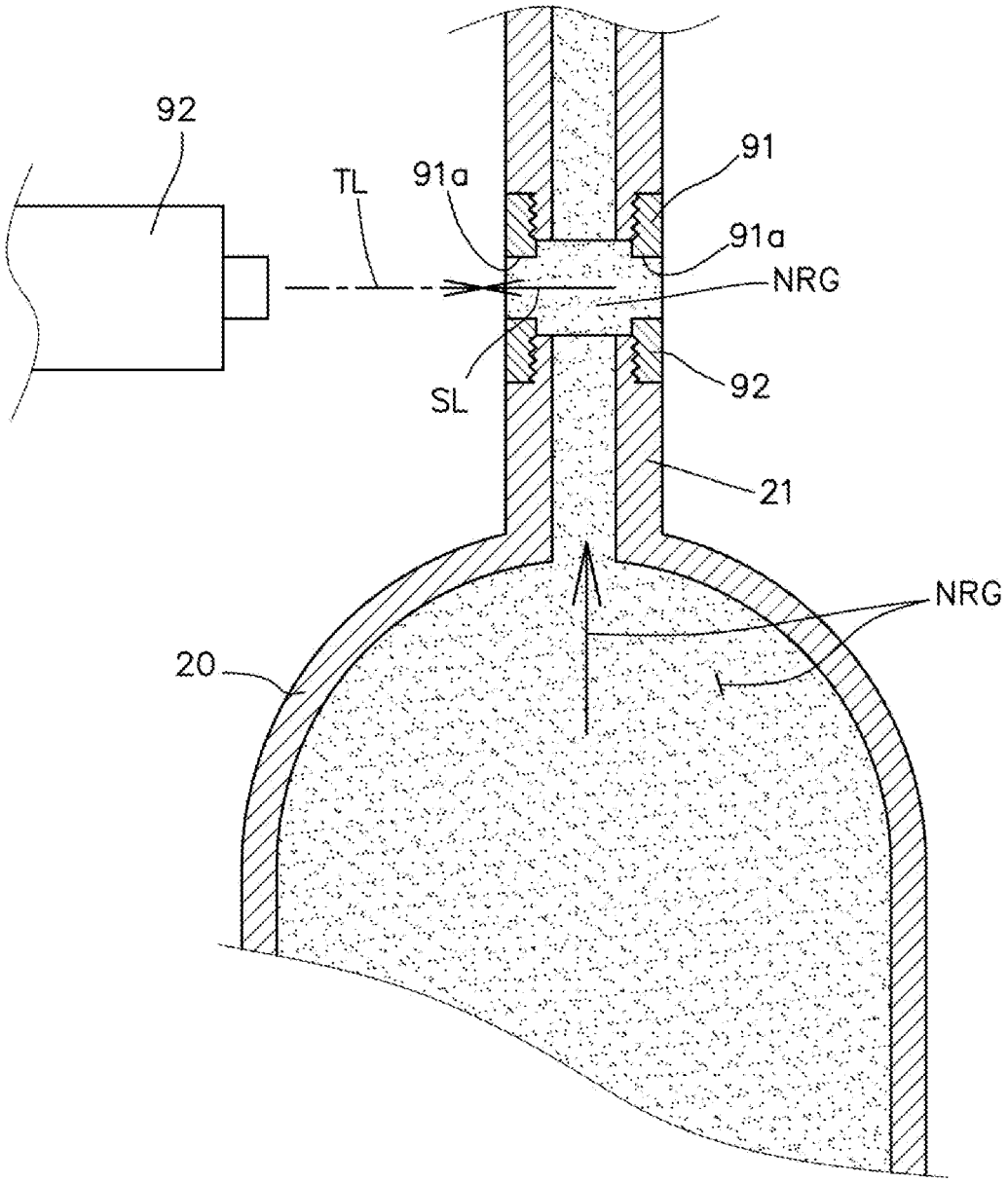
FIG. 2 is a cross-sectional view schematically illustrating a structure of a measuring block which is mounted on an outlet port of a canister provided in the apparatus for drying the spent nuclear fuel based on evaluation of drying characteristics obtained from gas spectroscopy according to one embodiment of the invention, in which a non-reactive gas discharged from the outlet port of the canister is irradiated by a transmitted layer emitted from a gas spectroscopy device through a transparent window, and the gas spectroscopy device receives a scattered light reflected from the non-reactive gas transmitted on the non-reactive gas.

Referring to FIGS. 1 and 2, an apparatus 10 for drying a spent nuclear fuel according to one embodiment of the invention dries a cavity of a canister 20 loaded with a spent nuclear fuel, the spent nuclear fuel and a spent nuclear fuel cladding by selectively circulating a non-reactive gas discharged from the canister 20 through a contaminated circulation system or a non-contaminated circulation system according to a contaminated or non-contaminated state.

The apparatus includes the canister 20 having the cavity provided with a gas inlet port 22 and a gas outlet port 21; a non-reactive gas source 50 which is configured to store the non-reactive gas to be supplied to the cavity of the canister 20; a first gas circulation pump PP1 which is mounted on a first gas circulation line P1 which fluidly connects the gas inlet port 22 of the canister 20 and the non-reactive gas source 50, to feed the non-reactive gas supplied from the non-reactive gas source 50 to the canister 20; a valve member 100 which is mounted on the first gas circulation line P1 between the first gas circulation pump PP1 and the canister 20 to open or close the first gas circulation line P1; a heater 90 which is mounted on the first gas circulation line P1 between the valve member 100 and the canister 20 to heat the non-reactive gas to be supplied to the canister 20; a gas cooling unit 30 which is fluidly coupled to the canister 20 through a second gas circulation line P2 to cool the non-reactive gas discharged from the cavity of the canister 20; a second gas circulation pump PP2 which is mounted on a third gas circulation line P3 to feed the non-reactive gas, which passes through the gas cooling unit 30, to the non-reactive gas source 50; a fourth gas circulation line P4 which is branched from the second gas circulation line P2, to fluidly connect the gas cooling unit 30 and the canister 20, separately from the second gas circulation line P2, thereby transferring a contaminated non-reactive gas, which is discharged from the canister 20, to the gas cooling unit 30; a branched valve member FV1 which is mounted on a branched point, from which the second and fourth gas circulation lines P2 and P4 are branched, to selectively open or close the second or fourth gas circulation line P2 or P4; a fifth gas circulation line P5 which is fluidly coupled to the fourth gas circulation line P4 to fluidly connect the gas cooling unit 30 and the non-reactive gas source 50; a particle filter 40 which is mounted on the fifth gas circulation line P5 to remove radioactive particles contained in the contaminated non-reactive gas which is transferred along the fifth gas circulation line P5 after the non-reactive gas passes through the gas cooling unit 30 along the fourth gas circulation line P4 to be cooled; a third gas circulation pump PP3 which is mounted on the fifth gas circulation line P5 to feed the non-reactive gas, which is cooled by the gas cooling unit 30 and is free of the radioactive particles through the particle filter 40, to the non-reactive gas source 50; a radiation dosimeter 60 which is installed outside the second gas circulation line P2 between the canister 20 and the branched valve member FV1 to measure a radiation dose rate of the non-reactive gas which is discharged from the canister 20 and is transferred along the second gas circulation line P2, and to send a measured signal; a controller 70 which is electrically connected to the first to third gas circulation pumps PP1, PP2 and PP3, the branched valve member FV1 and the radiation dosimeter 60, respectively, to determine pollution of the non-reactive gas discharged from the canister 20 based on the measured signal on the radiation dose rate which is received from the radiation dosimeter 60, and to control an operating state of the branched valve member FV1 and the first to third gas circulation pumps PP1, PP2 and PP3; a measuring block 91; a gas spectroscopy device 92; and a temperature measuring member 93 which is mounted on the gas outlet port 21 of the canister 20 to measure a temperature inside the canister 20.

The controller 70 is electrically connected to the gas spectroscopy device 92 and the temperature measuring member 93, and executes drying operation according to the measured values received from the gas spectroscopy device 92 and the temperature measuring member 93 to control execution of the drying operation.

The measuring block 91 is mounted on the gas outlet port 21 of the canister 20, and has a transparent window 91*a*.

The gas spectroscopy device 92 irradiates a transmitted laser onto the non-reactive gas discharged from the canister 20 through the transparent window 91*a* of the measuring block 91, and receives scattered light from the non-reactive gas to measure a gas spectroscopy signal which is indicative of components of the non-reactive gas and target components to send the measured value.

The temperature measuring member 93 is mounted on the gas outlet port 21 of the canister 20 to measure a temperature inside the canister 20.

Figure 3A:
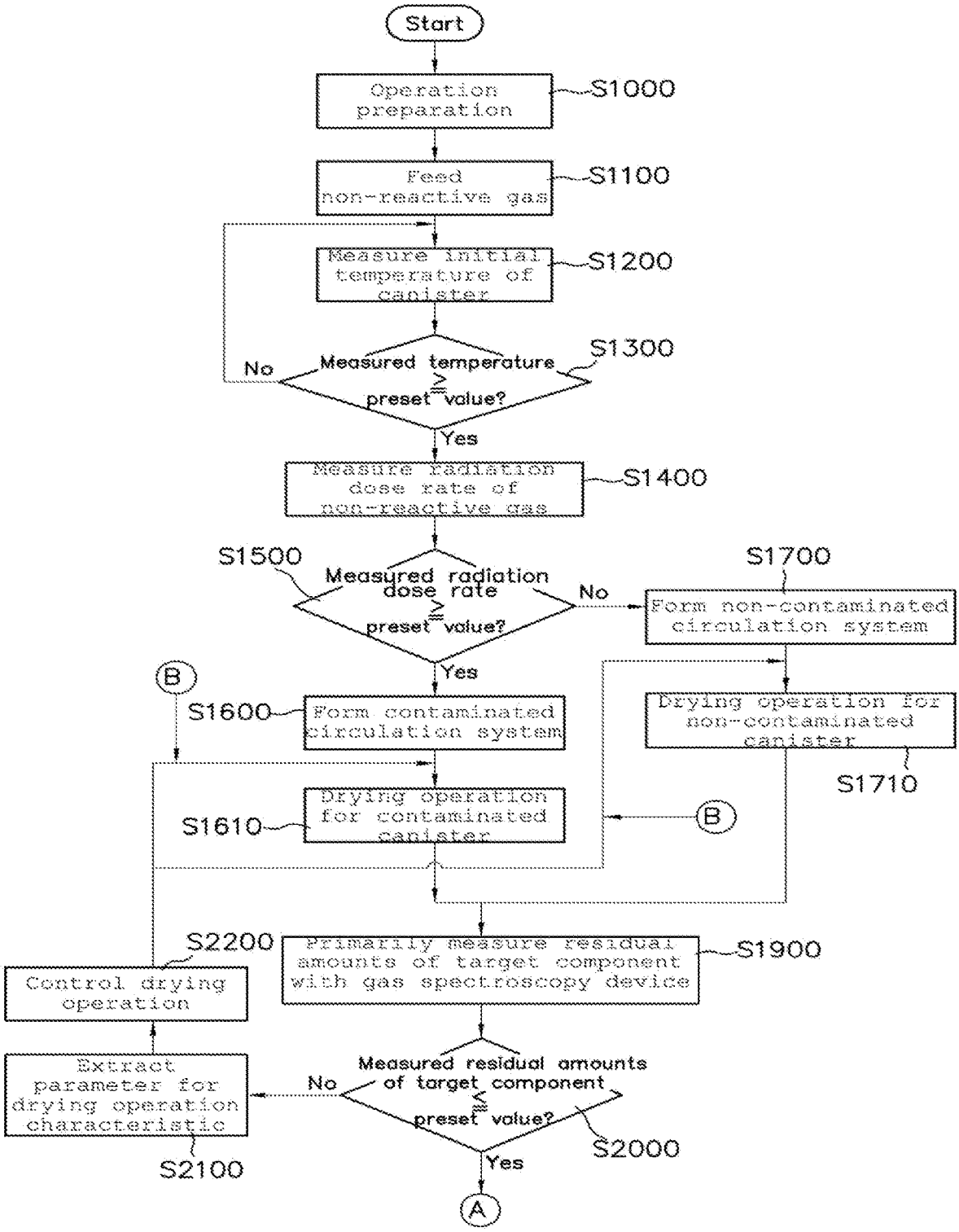
FIGS. 3A to 4B are flowcharts illustrating a method for controlling the apparatus for drying the spent nuclear fuel based on evaluation of drying characteristics obtained from gas spectroscopy according to one embodiment of the invention.
Figure 3B:
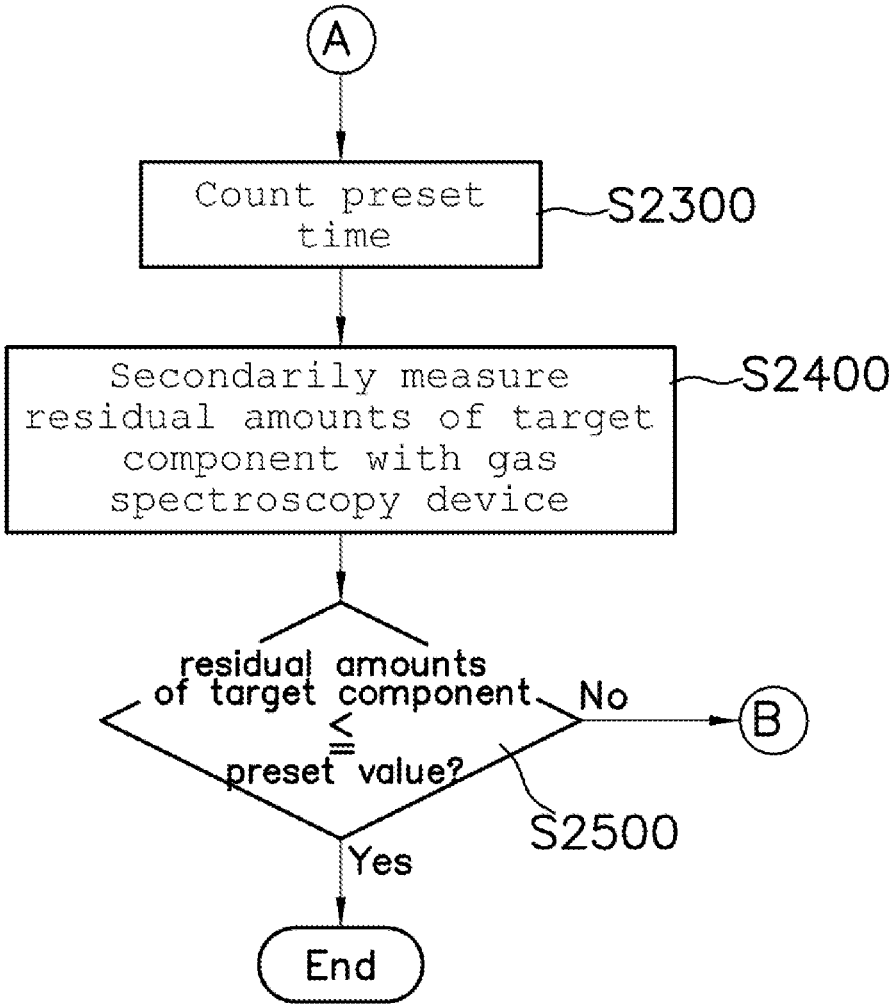

Referring to FIGS. 3A and 3B, a method for controlling the apparatus for drying the spent nuclear fuel based on evaluation of drying characteristics obtained from the gas spectroscopy according to one embodiment of the invention includes an operation preparing step S1000, a step S1100 of feeding the non-reactive gas, a step S1200 of measuring an initial temperature of the canister, a step S1300 of determining the initial temperature of the canister, a step S1400 of measuring a radiation dose rate of the non-reactive gas, a step S1500 of forming the contaminated circulation system, a step S1600 of forming the contaminated circulation system, a step S1610 of executing the drying operation of the contaminated canister, a step S1700 of forming the non-contaminated circulation system, a step S1710 of executing the drying operation of non-contaminated canister, a step S1900 of primarily measuring the gas spectroscopy, a step S2000 of primarily checking the drying state, a step S2100 of extracting the parameter for the drying operation characteristic, a step S2200 of controlling the drying operation, a step S2300 of counting the preset time, a step S2400 of secondarily measuring the gas spectroscopy, and a step S2500 of secondarily checking the drying state.

At the step S1000, the dried canister 20 is set to the gas circulation system so that the non-reactive gas is discharged from the predetermined gas outlet port 21 and is circulated, and a preset temperature value for starting normal drying operation, a preset parameter value for the drying operation, a preset drying reference value, and a preset reference radiation dose rate for determining whether the non-reactive gas is contaminated or not are inputted to the controller. The preset temperature value for starting the normal drying operation is in a range of 40 to 70° C.

At the step S1100, the non-reactive gas is fed to the cavity of the canister 20 through the first gas circulation line P1.

At the step S1200, the temperature of the non-reactive gas discharged from the gas outlet port 21 of the canister 20 is measured by the temperature measuring member 93 after the step S1100 is completed, and the measured value is sent to the controller 70.

At the S1300, it is determined whether or not the initial temperature value of the canister 20 measured at the step S1200 is above the preset temperature value for starting the normal drying operation.

If it is determined at the step S1300 that the initial temperature value of the canister 20 measured at the step S1200 is above the preset temperature value for starting the normal drying operation, it is measured at the step S1400 the radiation dose rate of the non-reactive gas which is discharged from the gas outlet port 21 of the canister 20 and is circulated along the second gas circulation line P2.

At the step S1500 it is determined whether or not the radiation dose rate of the non-reactive gas measured at the step S1400 is above a reference radiation dose rate.

If it is determined at the step S1500 that the measured radiation dose rate is above the reference radiation dose rate, at the step S1600, the first, sixth and eighth valve members V1, V6 and V8 are opened, and the branched valve member FV1 is opened toward the fourth gas circulation line P4 to form a contaminated circulation system consisting of the first, fourth and fifth gas circulation lines P1, P4 and P5.

If the step S1600 is completed, at the step S1610, the contaminated non-reactive gas is circulated along the contaminated circulation system via the canister 20, based on the preset parameter value for the drying operation which is inputted at the step S1000, to dry the cavity of the canister 20.

If it is determined at the step S1500 that the measured radiation dose rate is less than the reference radiation dose rate, at the step S1700, the first, fifth and seventh valve members V1, V5 and V7 and the valve member 100 are opened, and the branched valve member FV1 is opened toward the second gas circulation line P2 to form a non-contaminated circulation system consisting of the first, second and third gas circulation lines P1, P2 and P3.

If the step S1700 is completed, at the step S1710, the non-reactive gas is circulated along the contaminated circulation system or the non-contaminated circulation system via the canister 20, based on the preset parameter value for the drying operation which is inputted at the step S1000, to dry the cavity of the canister 20.

While the step S1610 or the step S1710 is executing, at the step S1900, it is measured a target component of the non-reactive gas discharged from the gas outlet port 21 and residual amounts of the target component with the gas spectroscopy device 92 which is mounted on the gas outlet port 21 of the canister 20.

At the step S2000, the measured residual amounts of the target component, which is measured at the step S1900, is compared with the preset drying reference value, to determine whether or not the measured residual amounts are less than the preset drying reference value.

If it is determined at the step S2000 that the measured residual amounts are above the preset drying reference value, at the step S2100, a parameter for drying operation characteristic corresponding to the measured residual amounts is measured to extract a preset parameter value for the drying operation characteristic. Specifically, the preset parameter value for the drying operation includes a pumping speed of the pump and a heating value of the heater. The preset parameter value for the drying operation characteristic includes a positive or negative value corresponding to the pumping speed of the pump, and a positive or negative value corresponding to the heating value of the heater, as a parameter for controlling the operation of the pump and the heater corresponding to a parameter of the drying operation. If the measured residual amounts are more than the preset drying reference value, at the step S2100, the pumping speed of the pump is extracted as the negative value, and the heating value of the heater is extracted as the positive value.

At the step S2200, the preset parameter value for the drying operation characteristic is inputted to the controller to control the drying operation, thereby applying the preset parameter value for the drying operation characteristic, which is extracted from the step S2100, to the steps S1610 and S1710, and then it proceeds to the step S1610 or the step S1710.

If it is determined at the step S2000 that the measured residual amounts are less than the preset drying reference value, a preset time is counted at the step S2300.

If the step S2300 is completed, at the step S2400, it is measured the target component of the non-reactive gas discharged from the gas outlet port 21 and residual amounts of the target component with the gas spectroscopy device 92 which is mounted on the gas outlet port 21 of the canister 20.

At the step S2500, the measured residual amounts of the target component, which is measured at the step S2400, is compared with the preset drying reference value, to determine whether or not the measured residual amounts are less than the preset drying reference value, and if the measured residual amounts are above the preset drying reference value, it proceeds to the step S1610 or the step S1710, or if the measured residual amounts are less than the preset drying reference value, the drying operation for the canister 20 is completed.

Referring to FIGS. 1 and 2, the apparatus for drying a spent nuclear fuel according to another embodiment of the invention dries a cavity of a canister 20 loaded with a spent nuclear fuel.

The apparatus includes the canister 20 having the cavity provided with a gas inlet port 22 and a gas outlet port 21; a non-reactive gas source 50 which is configured to store the non-reactive gas to be supplied to the cavity of the canister 20; a first gas circulation pump PP1 which is mounted on a first gas circulation line P1 which fluidly connects the gas inlet port 22 of the canister 20 and the non-reactive gas source 50, to feed the non-reactive gas supplied from the non-reactive gas source 50 to the canister 20; a valve member 100 which is mounted on the first gas circulation line P1 between the first gas circulation pump PP1 and the canister 20 to open or close the first gas circulation line P1; a heater 90 which is mounted on the first gas circulation line P1 between the valve member 100 and the canister 20 to heat the non-reactive gas to be supplied to the canister 20; a gas cooling unit 30 which is fluidly coupled to the canister 20 through a second gas circulation line P2 to cool the non-reactive gas discharged from the cavity of the canister 20; a second gas circulation pump PP2 which is mounted on a third gas circulation line P3 to feed the non-reactive gas, which passes through the gas cooling unit 30, to the non-reactive gas source 50; a fourth gas circulation line P4 which is branched from the second gas circulation line P2, to fluidly connect the gas cooling unit 30 and the canister 20, separately from the second gas circulation line P2, thereby transferring a contaminated non-reactive gas, which is discharged from the canister 20, to the gas cooling unit 30; a branched valve member FV1 which is mounted on a branched point, from which the second and fourth gas circulation lines P2 and P4 are branched, to selectively open or close the second or fourth gas circulation line P2 or P4; a fifth gas circulation line P5 which is fluidly coupled to the fourth gas circulation line P4 to fluidly connect the gas cooling unit 30 and the non-reactive gas source 50; a particle filter 40 which is mounted on the fifth gas circulation line P5 to remove radioactive particles contained in the contaminated non-reactive gas which is transferred along the fifth gas circulation line P5 after the non-reactive gas passes through the gas cooling unit 30 along the fourth gas circulation line P4 to be cooled; a third gas circulation pump PP3 which is mounted on the fifth gas circulation line P5 to feed the non-reactive gas, which is cooled by the gas cooling unit 30 and is free of the radioactive particles through the particle filter 40, to the non-reactive gas source 50; a radiation dosimeter 60 which is installed outside the second gas circulation line P2 between the canister 20 and the branched valve member FV1 to measure a radiation dose rate of the non-reactive gas which is discharged from the canister 20 and is transferred along the second gas circulation line P2, and to send a measured signal; a measuring block 91 which is mounted on the gas outlet port 21 of the canister 20, and has a transparent window 91*a*; a gas spectroscopy device 92 which irradiates a transmitted laser onto the non-reactive gas discharged from the canister 20 through the transparent window 91*a* of the measuring block 91, and receives scattered light from the non-reactive gas to measure a gas spectroscopy signal which is indicative of components of the non-reactive gas and target components to send the measured value; a temperature measuring member 93 which is mounted on the gas outlet port 21 of the canister 20 to measure a temperature inside the canister 20; a sixth gas circulation line P6 which is fluidly coupled to the second gas circulation line P2 between the canister 20 and the branched valve member FV1 and also to the third gas circulation line P3 between the gas cooling unit 30 and the second gas circulation pump PP2, to preliminarily circulate a non-contaminated non-reactive gas along the third gas circulation line P3 together with radioactive substance discharged from the gas outlet port 21 of the canister 20 at preliminary operation; a first valve member V1 which is mounted on the second gas circulation line P2 between the branched point of the second gas circulation line P6 and the branched valve member FV1 to close the second gas circulation line P2, thereby interrupting transfer of the non-reactive gas, which is discharged from the gas outlet port 21 of the canister 20 at the preliminary operation, to the gas cooling unit 30; second and third valve members V2 and V3 which are mounted on both ends of the sixth gas circulation line P6 to open or close the sixth gas circulation line P6 so that the non-reactive gas discharged from the gas outlet port 21 of the canister 20 at the preliminary operation flows along the sixth gas circulation line P6; a seventh gas circulation line P7 which is branched from the sixth gas circulation line P6 and is fluidly coupled to the fifth gas circulation line P5 between the gas cooling unit 30 and the particle filter 40, to preliminarily circulate the contaminated non-reactive gas along the fifth gas circulation line P5 together with the radioactive substance discharged from the gas outlet port 21 of the canister 20 at the preliminary operation; a fourth valve member V4 which is mounted on the seventh gas circulation line P7 to interrupt an end of the seventh gas circulation line P7 at the fifth gas circulation line P5 so that the non-reactive gas transferred from the gas cooling unit 30 along the fifth gas circulation line P5 flows to the seventh gas circulation line P7; a fifth valve member V5 which is mounted on the third gas circulation line P3 between the gas cooling unit 30 and the branched point of the sixth gas circulation line P6 to interrupt the third gas circulation line P3 so that the non-reactive gas flowing to the third gas circulation line P3 from the sixth gas circulation line P6 at the preliminary operation flows to the gas cooling unit 30; a sixth valve member V6 which is mounted on the fifth gas circulation line P5 between the gas cooling unit 30 and the branched point of the seventh gas circulation line P7 to interrupt the fifth gas circulation line P5 so that the non-reactive gas flowing to the fifth gas circulation line P5 from the seventh gas circulation line P7 at the preliminary operation flows to the gas cooling unit 30; a branched valve member FV2 which is mounted on a branched point of the sixth and seventh gas circulation lines P6 and P7 to selectively open or close the sixth or seventh gas circulation line P6 or P7; a seventh valve member V7 which is mounted on the third gas circulation line P3 between the second gas circulation pump PP2 and the non-reactive gas source 50 to interrupt the third gas circulation line P3 so that the non-reactive gas flowing along the third gas circulation line P3 at the preliminary operation flows to the non-reactive gas source 50; an eighth valve member V8 which is mounted on the fifth gas circulation line P5 between the third gas circulation pump PP3 and the non-reactive gas source 50 to interrupt the fifth gas circulation line P5 so that the non-reactive gas flowing along the fifth gas circulation line P5 at the preliminary operation flows to the non-reactive gas source 50; an eighth gas circulation line P8 which is fluidly coupled to the third gas circulation line P3 between the second gas circulation pump PP2 and the seventh valve member V7 and also to the first gas circulation line P1 between the valve member 100 and the heater 90, to preliminarily circulate the non-contaminated non-reactive gas along the first gas circulation line P1 together with radioactive substance flowing allowing the third gas circulation line P3 at the preliminary operation; ninth and eleventh valve members V9 and V11 which are mounted on both ends of the eighth gas circulation line P8 to open or close the eighth gas circulation line P8, thereby preventing the non-reactive gas circulating along the first and third gas circulation lines P1 and P3 at the drying operation from flowing to the eighth gas circulation line P8; a ninth gas circulation line P9 which is fluidly coupled to the fifth gas circulation line P5 between the third gas circulation pump PP3 and the eighth valve member V8 and also to the eighth gas circulation line P8 between the ninth valve member V9 and the eleventh valve member V11, to circulate the non-reactive gas, which is flowing along the fifth gas circulation line P5 at the preliminary operation, along the eighth gas circulation line P8; a tenth valve member V10 which is mounted on an end of the ninth gas circulation line P9 at a side of the fifth gas circulation line P5 to shut off the ninth gas circulation line P9, thereby preventing the non-reactive gas circulating along the fifth gas circulation line P5 at the drying operation from flowing to the ninth gas circulation line P9; and a controller 70 which is electrically connected to the first to third gas circulation pumps PP1, PP2 and PP3, the branched valve member FV1, the radiation dosimeter 60, the gas spectroscopy device 92, the temperature measuring member 93, the first to eleventh valve members V1 to V11, the valve member 100, the second and third gas circulation pumps PP2 and PP3 and the heater 90, respectively, to determine pollution of the non-reactive gas discharged from the canister 20 based on the measured signal on the radiation dose rate which is received from the radiation dosimeter 60, and to control an operating state of the branched valve member FV1 and the first to third gas circulation pumps PP1, PP2 and PP3 according to the determined results and an operating state of the first to eleventh valve members V1 to V11, the valve member 100, the second and third gas circulation pumps PP2 and PP3 and the heater 90 according to the measured cavity temperature of the canister 20 received from the temperature measuring member 93 and the measured values received from the radiation dosimeter 60 at the preliminary operation, thereby drying the cavity of the canister 20 by selectively circulating the non-reactive gas discharged from the canister 20 through a contaminated circulation system or a non-contaminated circulation system according to a contaminated or non-contaminated state, as well as executing and controlling the preliminary operation and the drying operation according to the measured values received from the gas spectroscopy device 92 and the temperature measuring member 93.

Figure 4A:
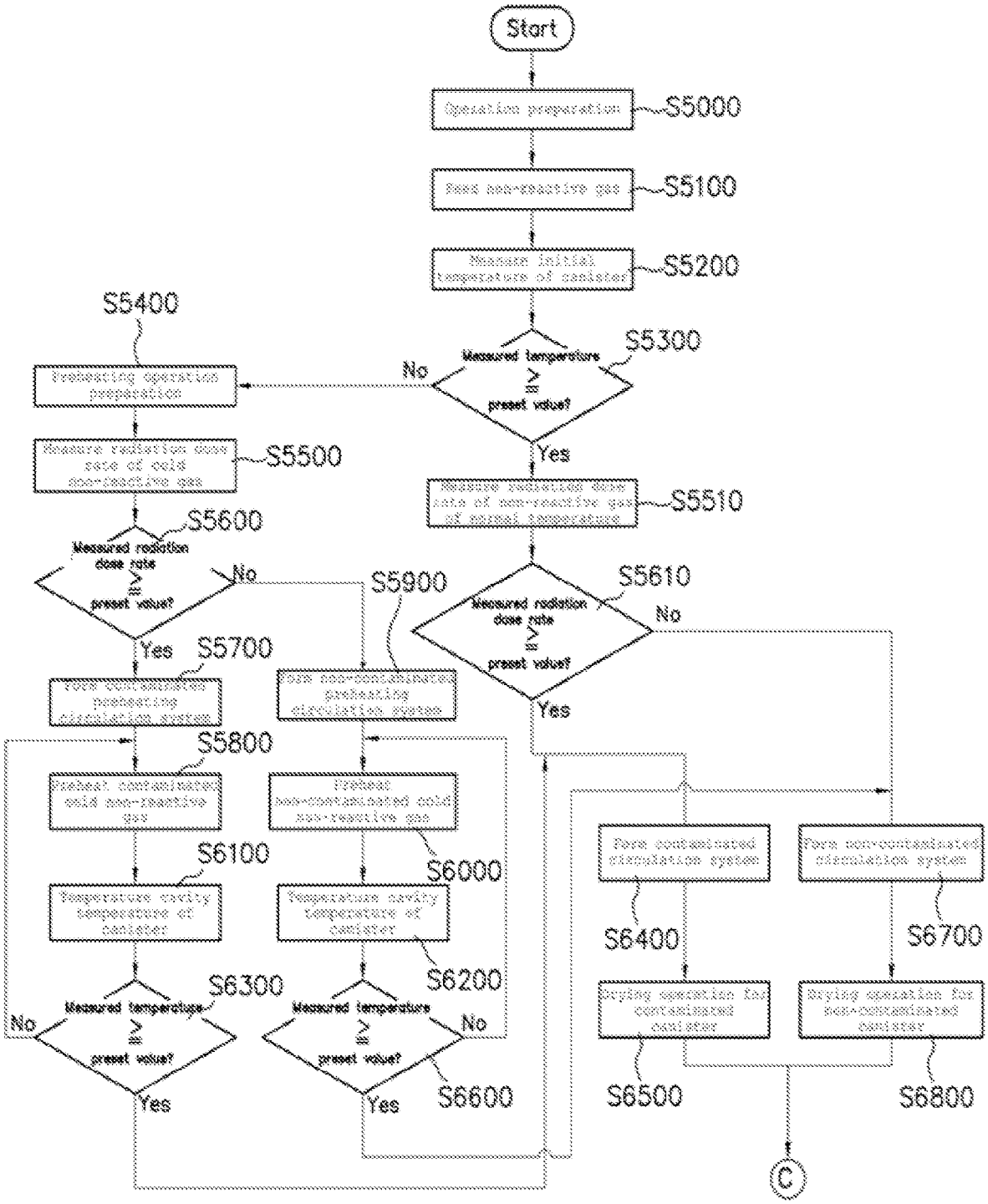
Figure 4B:
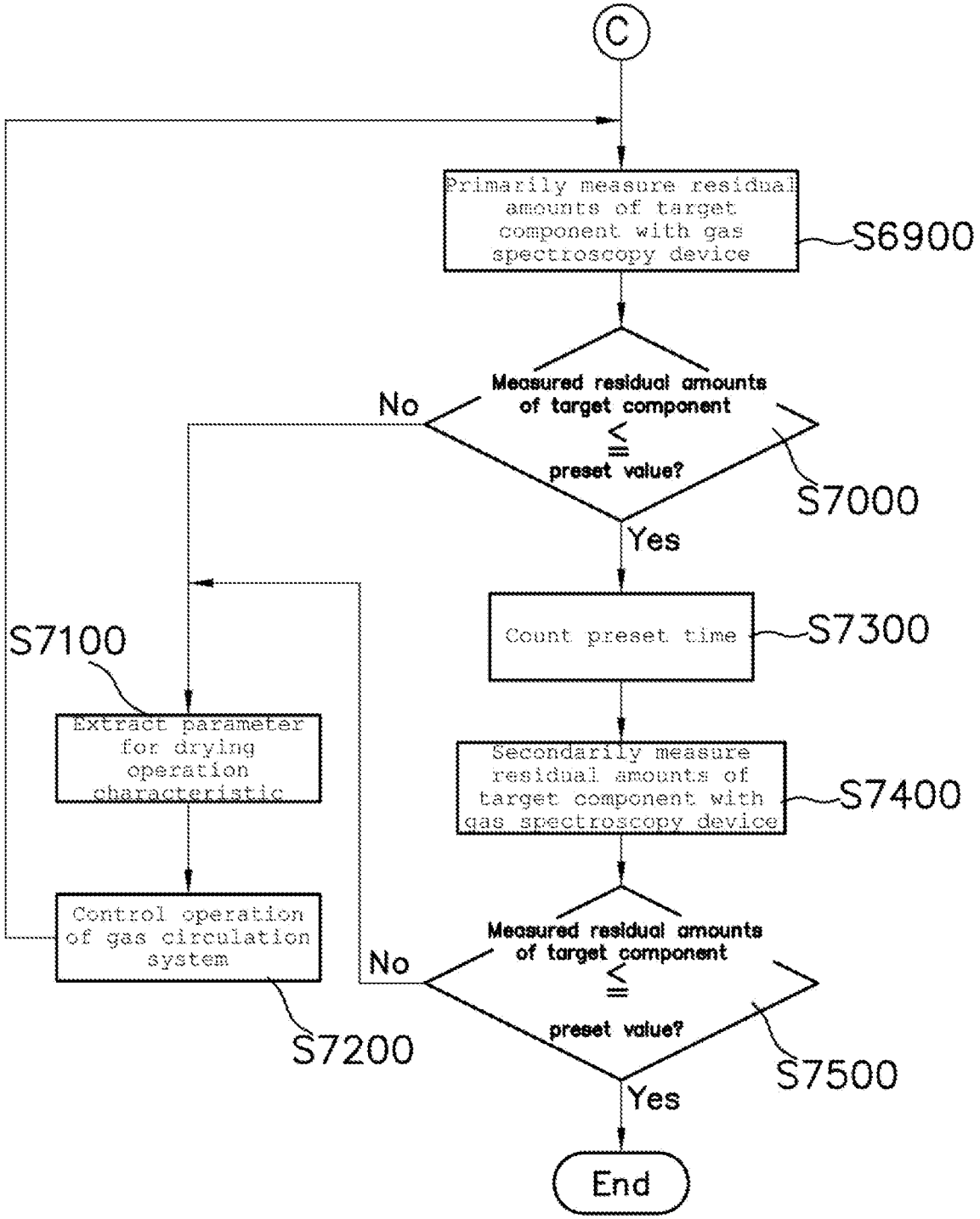

Referring to FIGS. 4A and 4B, a method for controlling the apparatus 10 which dries the spent nuclear fuel based on evaluation of drying characteristics obtained from the gas spectroscopy according to another embodiment of the invention includes an operation preparing step S5000, a step S5100 of feeding the non-reactive gas, a step S5200 of measuring an initial temperature of the canister, a step S5300 of determining the initial temperature of the canister, a step S5400 of preparing preheating operation, a step S5500 of measuring a radiation dose rate of the cold non-reactive gas, a step S5510 of measuring a radiation dose rate of the non-reactive gas of a normal temperature, a step S5600 of determining whether the cold non-reactive gas is contaminated, a step S5610 of determining whether the non-reactive gas of the normal temperature is contaminated, a step S5700 of forming the contaminated preheating circulation system, a step S5800 of preheating the contaminated cold non-reactive gas, a step S5900 of forming the non-contaminated preheating circulation system, a step S6000 of preheating the non-contaminated cold non-reactive gas, a step S6100 of measuring the cavity temperature of the canister while preheating the contaminated cold non-reactive gas, a step S6200 of measuring the cavity temperature of the canister while preheating the non-contaminated cold non-reactive gas, a step S6300 of checking the cavity temperature of the canister while preheating the contaminated cold non-reactive gas, a step S6400 of forming the normal contaminated circulation system, a step S6500 of executing the drying operation of the contaminated canister, a step S6600 of checking the cavity temperature of the canister while preheating the non-contaminated cold non-reactive gas, a step S6700 of forming the normal non-contaminated circulation system, a step S6800 of executing the drying operation of the non-contaminated canister, a step S6900 of primarily measuring the gas spectroscopy, a step S7000 of primarily checking the drying state, a step S7100 of extracting the parameter for the drying operation characteristic, a step S7200 of controlling the gas circulation system, a step S7300 of counting the preset time, a step S7400 of secondarily measuring the gas spectroscopy, and a step S7500 of secondarily checking the drying state.

At the step S5000, the dried canister 20 is set to the gas circulation system so that the non-reactive gas is discharged from the predetermined gas outlet port 21 and is circulated, and a preset temperature value for starting normal drying operation, a preset parameter value for the drying operation, a preset drying reference value, and a preset reference radiation dose rate for determining whether the non-reactive gas is contaminated or not are inputted to the controller to prepare the operation.

In this instance, the preset temperature value for starting the normal drying operation is in a range of 40 to 70° C., and the preset parameter value for the drying operation includes a pumping speed of the pump and a heating value of the heater.

At the step S5100, the non-reactive gas is fed to the cavity of the canister 20 through the first gas circulation line P1.

At the step S5200, the temperature of the non-reactive gas discharged from the gas outlet port 21 of the canister 20 is measured by the temperature measuring member 93 after the step S5100 is completed, and the measured value is sent to the controller 70.

At the step S5300, it is determined whether or not the initial temperature value of the canister 20 measured at the step S5200 is above the preset temperature value for starting the normal drying operation.

If it is determined at the step S5300 that the measured initial temperature value of the canister 20 is less than the preset temperature value for starting the normal drying operation, at the step S5400, the valve member 100, the first, fifth, sixth, seventh and eighth valve members V1, V5, V6, V7 and V8 are closed, the second and eleventh valve members V2 and V11 are opened, and the heater 90 is turned on to preheat the canister;

If the step S5400 is completed, it is measured at the step S5500 the radiation dose rate of the cold non-reactive gas which is discharged from the gas outlet port 21 of the canister 20 and is circulated along the sixth gas circulation line P6.

If it is determined at the step S5300 that the measured initial temperature value of the canister 20 is above the preset temperature value for starting the normal drying operation, it is measured at the step S5510 the radiation dose rate of the non-reactive gas which is discharged from the gas outlet port 21 of the canister 20 and is circulated along the second gas circulation line P2.

At the step S5600, it is determined whether or not the radiation dose rate of the cold non-reactive gas measured at the step S5500 is above a reference radiation dose rate.

At the step S5610, it is determined whether or not the radiation dose rate of the non-reactive gas of the normal temperature measured at the step S5510 is above the reference radiation dose rate.

If it is determined at the step S5600 that the measured radiation dose rate is above the reference radiation dose rate, at the step S5700, the branched valve member FV2 is opened toward the seventh gas circulation line P7, and the fourth and tenth valve members V4 and V10 are opened to form a contaminated preheating circulation system consisting of the canister 20, the seventh, fifth, ninth, eighth and first gas circulation lines P7, P5, P9, P8 and P1.

If the step S5700 is completed, at the step S5800, the third gas circulation pump PP3 is turned on to circulate the contaminated cold non-reactive gas along the contaminated preheating circulation system, thereby raising the cavity temperature of the canister 20 by the preset value for the normal drying operation.

If it is determined at the step S5600 that the measured radiation dose rate is less than the reference radiation dose rate, at the step S5900, the branched valve member FV2 is opened toward the sixth gas circulation line P6, and the third and ninth valve members V3 and V9 are opened to form a non-contaminated preheating circulation system consisting of the canister 20, the sixth, third, eighth first gas circulation lines P6, P3, P8 and P1.

If the step S5900 is completed, at the step S6000, the third gas circulation pump PP3 is turned on to circulate the non-contaminated cold non-reactive gas along the non-contaminated preliminary circulation system, so that the cavity temperature of the canister 20 raises up to the preset temperature value for starting the normal drying operation.

While the step S5800 is executing, at the step S6100, it is measured the temperature of the non-reactive gas discharged from the gas outlet port 21 of the canister 20 to measure the cavity temperature of the canister while preheating the contaminated cold non-reactive gas.

While the step S6000 is executing, at the step S6200, it is measured the temperature of the non-reactive gas discharged from the gas outlet port 21 of the canister 20 to measure the cavity temperature of the canister while preheating the non-contaminated non-reactive gas.

At the step S6300, it is determined whether or not the cavity temperature of the canister 20 measured at the step S6100 reaches the preset temperature value for starting the normal drying operation, and if the measured cavity temperature of the canister 20 does not reach the preset temperature value for starting the normal drying operation, it proceeds to the step S5800.

If it is determined at the step S6300 that the measured cavity temperature of the canister 20 is more than the preset temperature value for starting the normal drying operation or if it is determined at the step S5610 that the measured radiation dose rate of the non-reactive gas of the normal temperature is above the reference radiation dose rate, at the step S6400, the branched valve member FV1 is opened toward the fourth gas circulation line P4, the valve member 100, the first, sixth, and eighth valve members V1, V6 and V8 are opened, and the second, fourth, tenth and eleventh valve members V2, V4, V10 and V11 are closed to form a normal contaminated drying circulation system consisting of the canister 20, the fourth gas circulation line P4, the gas cooling unit 30, the fifth gas circulation line P5, the non-reactive gas source 50 and the first gas circulation line P1.

If the step S6400 is completed, at the step S6500, the first and third gas circulation pumps PP1 and PP3 and the gas cooling unit 30 are turned on to circulate the contaminated non-reactive gas along the normal contaminated circulation system, based on the preset parameter value for the drying operation which is inputted at the step S5000, thereby drying the cavity of the canister 20.

At the step S6600, it is determined whether or not the cavity temperature of the canister 20 measured at the step S6200 reaches the preset temperature value for starting the normal drying operation, and if the measured cavity temperature of the canister 20 does not reach the preset temperature value for starting the normal drying operation, it proceeds to the step S6000.

If it is determined at the step S6600 that the measured cavity temperature of the canister 20 is more than the preset temperature value for starting the normal drying operation or if it is determined at the step S5610 that the measured radiation dose rate of the non-reactive gas of the normal temperature is less than the reference radiation dose rate, at the step S6700, the branched valve member FV1 is opened toward the second gas circulation line P2, the valve member 100, the first, fifth and seventh valve members V1, V5 and V7 are opened, and the second, third, ninth and eleventh valve members V2, V3, V9 and V11 are closed to form a normal non-contaminated drying circulation system consisting of the canister 20, the second gas circulation line P2, the gas cooling unit 30, the third gas circulation line P3, the non-reactive gas source 50 and the first gas circulation line P1.

If the step S6700 is completed, at the step S6800, the first and second gas circulation pumps PP1 and PP2 and the gas cooling unit 30 are turned on to circulate the non-contaminated non-reactive gas along the normal non-contaminated circulation system based on the preset parameter value for the drying operation which is inputted at the step S5000, thereby drying the non-contaminated cavity of the canister 20.

While the step S6500 or the step S6800 is executing, a step S6900 of measuring a target component of the non-reactive gas discharged from the gas outlet port 21 and residual amounts of the target component with the gas spectroscopy device 92 which is mounted on the gas outlet port 21 of the canister 20.

At the step S7000, the measured residual amounts of the target component, which is measured at the step S6900, is compared with the preset drying reference value, to determine whether or not the measured residual amounts are less than the preset drying reference value.

If it is determined at the step S7000 that the measured residual amounts are above the preset drying reference value, at the step S7100 it is computed a parameter for drying operation characteristic corresponding to the measured residual amounts to extract a preset parameter value for the drying operation characteristic. Specifically, if the measured residual amounts are more than the preset drying reference value, the pumping speed of the pump is extracted as the negative value, and the heating value of the heater is extracted as the positive value.

At the S7200, the preset parameter value for the drying operation characteristic is inputted to the controller, thereby applying the preset parameter value for the drying operation characteristic, which is extracted from the step S7100, to the drying operation and thus controlling the operation of the gas circulation system, and then it proceeds to the step S6900. The preset parameter value for the drying operation characteristic includes a positive or negative value corresponding to the pumping speed of the pump, and a positive or negative value corresponding to the heating value of the heater, as a parameter for controlling the operation of the pump and the heater corresponding to a parameter of the drying operation.

If it is determined at the step S7000 that the measured residual amounts are less than the preset drying reference value, a preset time is counted at the step S7300.

If the step S7300 is completed, at the step S7400, it is measured the target component of the non-reactive gas discharged from the gas outlet port 21 and residual amounts of the target component with the gas spectroscopy device 92 which is mounted on the gas outlet port 21 of the canister 20.

At the step S7500, the measured residual amounts of the target component, which is measured at the step S7400, is compared with the preset drying reference value, to determine whether or not the measured residual amounts are less than the preset drying reference value, and if the measured residual amounts are more than the preset drying reference value, proceeding to the step S7100, or if the measured residual amounts are below the preset drying reference value, the drying operation for the canister 20 is completed.

With the above configuration, the apparatus automatically evaluates suitability of drying for the canister to be dried by use of gas spectroscopy at the process of drying the canister to check achievement of quick drying target, obtain the optimum dry state, quickly and accurately determine whether or not the canister is contaminated by a damaged spent nuclear fuel, and execute the process of drying the canister by selectively circulating the non-reactive gas along the non-contaminated circulation system or the contaminated circulation system, thereby preventing the apparatus from being polluted by the radiation which is caused from the damaged spent nuclear fuel, and also minimizing the worker from being exposed to the radiation by automatically controlling the drying process.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

This work (patent application) was supported by the Korea Institute of Energy Technology Evaluation and Planning (KETEP) and the Ministry of Trade, Industry & Energy (MOTIE) of the Republic of Korea (No. 20181720201020).

What is claimed is:

1. An apparatus for a drying operation that dries a cavity of a canister loaded with spent nuclear fuel, the spent nuclear fuel and a spent nuclear fuel cladding by selectively circulating a non-reactive gas discharged from the canister through a contaminated circulation system or a non-contaminated circulation system according to a contaminated or non-contaminated state, the apparatus comprising:

the canister having the cavity provided with a gas inlet port and a gas outlet port;

a non-reactive gas source which is configured to store non-reactive gas to be supplied to the cavity of the canister;

a first gas circulation pump which is mounted on a first gas circulation line which fluidly connects the gas inlet port of the canister and the non-reactive gas source, to feed the non-reactive gas supplied from the non-reactive gas source to the canister;

a valve member which is mounted on the first gas circulation line between the first gas circulation pump and the canister to open or close the first gas circulation line;

a heater which is mounted on the first gas circulation line between the valve member and the canister to heat the non-reactive gas to be supplied to the canister;

a gas cooling unit which is fluidly coupled to the canister through a second gas circulation line to cool the non-reactive gas discharged from the cavity of the canister;

a second gas circulation pump which is mounted on a third gas circulation line to feed the non-reactive gas, which passes through the gas cooling unit, to the non-reactive gas source;

a fourth gas circulation line which is branched from the second gas circulation line, to fluidly connect the gas cooling unit and the canister, separately from the second gas circulation line, thereby transferring a contaminated non-reactive gas, which is discharged from the canister, to the gas cooling unit;

a branched valve member which is mounted on a branched point, from which the second and fourth gas circulation lines are branched, to selectively open or close the second or fourth gas circulation line;

a fifth gas circulation line which is fluidly coupled to the fourth gas circulation line to fluidly connect the gas cooling unit and the non-reactive gas source;

a particle filter which is mounted on the fifth gas circulation line to remove radioactive particles contained in the contaminated non-reactive gas which is transferred along the fifth gas circulation line after the non-reactive gas passes through the gas cooling unit along the fourth gas circulation line to be cooled;

a third gas circulation pump which is mounted on the fifth gas circulation line to feed the non-reactive gas, which is cooled by the gas cooling unit and is free of the radioactive particles through the particle filter, to the non-reactive gas source;

a radiation dosimeter which is installed outside the second gas circulation line between the canister and the branched valve member to measure a radiation dose rate of the non-reactive gas which is discharged from the canister and is transferred along the second gas circulation line, and to send a measured signal;

a controller which is electrically connected to the first to third gas circulation pumps, the branched valve member and the radiation dosimeter, respectively, to determine pollution of the non-reactive gas discharged from the canister based on the measured signal on the radiation dose rate which is received from the radiation dosimeter, and to control an operating state of the branched valve member and the first to third gas circulation pumps;

a measuring block which is mounted on the gas outlet port of e canister, and has a transparent window;

a gas spectroscopy device which irradiates a transmitted laser onto the non-reactive gas discharged from the canister through the transparent window of the measuring block, and receives scattered light from the non-reactive gas to measure a gas spectroscopy signal which is indicative of components of the non-reactive gas and target components to send measured values; and a temperature measuring member which is mounted on the gas outlet port of the canister to measure a temperature inside the canister, wherein the controller is electrically connected to the gas spectroscopy device and the temperature measuring member, and executes the drying operation according to the measured values received from the gas spectroscopy device and the temperature measuring member to control execution of the drying operation.

2. The apparatus according to claim 1, further comprising a sixth gas circulation line which is fluidly coupled to the second gas circulation line between the canister and the branched valve member and also to the third gas circulation line between the gas cooling unit and the second gas circulation pump, to preliminarily circulate a non-contaminated non-reactive gas along the third gas circulation line together with radioactive substance discharged from the gas outlet port of the canister at preliminary operation performed before or in a preparation step;

a first valve member which is mounted on the second gas circulation line between the branched point of the second gas circulation line and the branched valve member to close the second gas circulation line, thereby interrupting transfer of the non-reactive gas, which is discharged from the gas outlet port of the canister at the preliminary operation, to the gas cooling unit;

second and third valve members which are mounted on both ends of the sixth gas circulation line to open or close the sixth gas circulation line so that the non-reactive gas discharged from the gas outlet port of the canister at the preliminary operation flows along the sixth gas circulation line;

a seventh gas circulation line which is branched from the sixth gas circulation line and is fluidly coupled to the fifth gas circulation line between the gas cooling unit and the particle filter, to preliminarily circulate the contaminated non-reactive gas along the fifth gas circulation line together with the radioactive substance discharged from the gas outlet port of the canister at the preliminary operation;

a fourth valve member which is mounted on the seventh gas circulation line to interrupt an end of the seventh gas circulation line at the fifth gas circulation line so that the non-reactive gas transferred from the gas cooling unit along the fifth gas circulation line flows to the seventh gas circulation line;

a fifth valve member which is mounted on the third gas circulation line between the gas cooling unit and the branched point of the sixth gas circulation line to interrupt the third gas circulation line so that the non-reactive gas flowing to the third gas circulation line from the sixth gas circulation line at the preliminary operation flows to the gas cooling unit;

a sixth valve member which is mounted on the fifth gas circulation line between the gas cooling unit and the branched point of the seventh gas circulation line to interrupt the fifth gas circulation line so that the non-reactive gas flowing to the fifth gas circulation line from the seventh gas circulation line at the preliminary operation flows to the gas cooling unit;

a branched valve member which is mounted on a branched point of the sixth and seventh gas circulation lines to selectively open or close the sixth or seventh gas circulation line;

a seventh valve member which is mounted on the third gas circulation line between the second gas circulation pump and the non-reactive gas source to interrupt the third gas circulation line so that the non-reactive gas flowing along the third gas circulation line at the preliminary operation flows to the non-reactive gas source;

an eighth valve member which is mounted on the fifth gas circulation line between the third gas circulation pump and the non-reactive gas source to interrupt the fifth gas circulation line so that the non-reactive gas flowing along the fifth gas circulation line (P5) at the preliminary operation flows to the non-reactive gas source (50);

an eighth gas circulation line which is fluidly coupled to the third gas circulation line between the second gas circulation pump and the seventh valve member and also to the first gas circulation line between the valve member and the heater, to preliminarily circulate the non-contaminated non-reactive gas along the first gas circulation line together with radioactive substance flowing along the third gas circulation line at the preliminary operation;

ninth and eleventh valve members which are mounted on both ends of the eighth gas circulation line to open or close the eighth gas circulation line, thereby preventing the non-reactive gas circulating along the first and third gas circulation lines at the drying operation from flowing to the eighth gas circulation line;

a ninth gas circulation line which is fluidly coupled to the fifth gas circulation line between the third gas circulation pump and the eighth valve member and also to the eighth gas circulation line between the ninth valve member and the eleventh valve member, to circulate the non-reactive gas, which is flowing along the fifth gas circulation line at the preliminary operation, along the eighth gas circulation line; and a tenth valve member which is mounted on an end of the ninth gas circulation line at a side of the fifth gas circulation line (P5) to shut off the ninth gas circulation line, thereby preventing the non-reactive gas circulating along the fifth gas circulation line at the drying operation from flowing to the ninth gas circulation line, wherein the controller is electrically connected to the first to eleventh valve members, the radiation dosimeter, the valve member, the branched valve member, the second and third gas circulation pumps, the heater, the gas spectroscopy device and the temperature measuring member, respectively, and executes the preliminary operation by controlling operation of the first to eleventh valve members, the valve member, the branched valve member, the second and third gas circulation pumps, and the heater, according to a measured indoor temperature value of the canister which is received from the temperature measuring member and the detected value received from the radiation dosimeter at the preliminary operation, to control execution of the drying operation.

3. A method of controlling an apparatus for drying a cavity of a canister loaded with spent nuclear fuel based on evaluation of drying characteristics Obtained from gas spectroscopy, wherein the apparatus includes: the canister having the cavity provided with a gas inlet port and a gas outlet port; a non-reactive gas source which is configured to store non-reactive gas to be supplied to the cavity of the canister; a first gas circulation pump which is mounted on a first gas circulation line which fluidly connects the gas inlet port of the canister and the non-reactive gas source, to feed the non-reactive gas supplied from the non-reactive gas source to the canister; a valve member which is mounted on the first gas circulation line between the first gas circulation pump and the canister to open or close the first gas circulation line; a heater which is mounted on the first gas circulation line between the valve member and the canister to heat the non-reactive gas to be supplied to the canister; a gas cooling unit which is fluidly coupled to the canister through a second gas circulation line to cool the non-reactive gas discharged from the cavity of the canister; a second gas circulation pump which is mounted on a third gas circulation line to feed the non-reactive gas, which passes through the gas cooling unit, to the non-reactive gas source; a fourth gas circulation line which is branched from the second gas circulation line, to fluidly connect the gas cooling unit and the canister, separately from the second gas circulation line, thereby transferring a contaminated non-reactive gas, which is discharged from the canister, to the gas cooling unit; a branched valve member which is mounted on a branched point, from which the second and fourth gas circulation lines are branched, to selectively open or close the second or fourth gas circulation line; a fifth gas circulation line which is fluidly coupled to the fourth gas circulation line to fluidly connect the gas cooling unit and the non-reactive gas source; a particle filter which is mounted on the fifth gas circulation line to remove radioactive particles contained in the contaminated non-reactive gas which is transferred along the fifth gas circulation line after the non-reactive gas passes through the gas cooling unit along the fourth gas circulation line to be cooled; a third gas circulation pump which is mounted on the fifth gas circulation line to feed the non-reactive gas, which is cooled by the gas cooling unit and is free of the radioactive particles through the particle filter, to the non-reactive gas source; a radiation dosimeter which is installed outside the second gas circulation line between the canister and the branched valve member to measure a radiation dose rate of the non-reactive gas which is discharged from the canister and is transferred along the second gas circulation line, and to send a measured signal; a measuring block which is mounted on the gas outlet port of the canister, and has a transparent window; a gas spectroscopy device which irradiates a transmitted laser onto the non-reactive gas discharged from the canister through the transparent window of the measuring block, and receives scattered light from the non-reactive gas to measure a gas spectroscopy signal which is indicative of components of the non-reactive gas and target components to send measured values; a temperature measuring member which is mounted on the gas outlet port of the canister to measure a temperature inside the canister; and a controller which is electrically connected to the first to third gas circulation pumps, the branched valve member, the radiation dosimeter, the gas spectroscopy device and the temperature measuring member, respectively, to determine pollution of the non-reactive gas discharged from the canister based on the measured signal on the radiation dose rate which is received from the radiation dosimeter, and to control an operating state of the branched valve member and the first to third gas circulation pumps, thereby drying the cavity of the canister by selectively circulating the non-reactive gas discharged from the canister through a contaminated circulation system or a non-contaminated circulation system according to a contaminated or non-contaminated state, as well as executing and controlling preliminary operation performed before or in a preparation step and the drying operation according to the measured values received from the gas spectroscopy device and the temperature measuring member, the method comprising:

a step 1000 of setting the dried canister to a gas circulation system so that the non-reactive gas is discharged from a predetermined gas outlet port and is circulated, and inputting a preset temperature value for starting a first drying operation, a preset parameter value for the drying operation, a preset drying reference value, and a preset reference radiation dose rate for determining whether the non-reactive gas is contaminated or not, to prepare the operation;

a step 1100 of feeding the non-reactive gas to the cavity of the canister through the first gas circulation line;

a step 1200 of measuring the temperature of the non-reactive gas discharged from the gas outlet port of the canister by the temperature measuring member after the step of feeding the non-reactive gas is completed, and sending the measured values to the controller;

a step 1300 of determining whether or not the measured temperature of the canister is above the preset temperature value for starting the drying operation;

if it is determined that the measured temperature of the canister is above the preset temperature value for starting the drying operation, a step 1400 of measuring the radiation dose rate of the non-reactive gas which is discharged from the gas outlet port of the canister and is circulated along the second gas circulation line;

a step 1500 of determining whether or not the measured radiation dose rate of the non-reactive gas is above a reference radiation dose rate;

if it is determined that the measured radiation dose rate is above the reference radiation dose rate, a step 1600 of opening the first, sixth and eighth valve members and opening the branched valve member toward the fourth gas circulation line to form a contaminated circulation system consisting of the first, fourth and fifth gas circulation lines;

a step 1610 of circulating the contaminated non-reactive gas along the contaminated circulation system via the canister, based on the preset parameter value for the drying operation, to dry the cavity of the canister;

if it is determined that the measured radiation dose rate is less than the reference radiation dose rate; a step 1700 of opening the first; fifth and seventh valve members and the valve member, and opening the branched valve member toward the second gas circulation line to form a non-contaminated circulation system consisting of the first, second and third gas circulation lines;

a step 1800 of circulating the non-reactive gas along the contaminated circulation system or the non-contaminated circulation system via the canister, based on the preset parameter value for the drying operation, to dry the cavity of the canister;

a step 1900 of measuring a target component of the non-reactive gas discharged from the gas outlet port and residual amounts of the target component with the gas spectroscopy device which is mounted on the gas outlet port of the canister;

a step 2000 of comparing the measured residual amounts of the target component with the preset drying reference value, to determine whether or not the measured residual amounts are less than the preset drying reference value;

if it is determined that the measured residual amounts are above the preset drying reference value, a step 2100 of computing a parameter for drying operation characteristic corresponding to the measured residual amounts to extract a preset parameter value for the drying operation characteristic;

a step 2200 of inputting the preset parameter value for the drying operation characteristic to control the drying operation in order for applying the preset parameter value for the drying operation characteristic to the step of circulating the contaminated non-reactive gas or the step of circulating the non-reactive gas and proceeding to the step of circulating the contaminated non-reactive gas or the step of circulating the non-reactive gas;

if it is determined at the step that the measured residual amounts are less than the preset drying reference value, a step 2300 of counting a preset time;

if the preset time is expired, a step 2400 of measuring the target component of the non-reactive gas discharged from the gas outlet port and residual amounts of the target component with the gas spectroscopy device which is mounted on the gas outlet port of the canister;

a step 2500 of comparing the measured residual amounts of the target component with the preset drying reference value and determining whether or not the measured residual amounts are less than the preset drying reference value, and if the measured residual amounts are above the preset drying reference value, proceeding to the step of circulating the contaminated non-reactive gas or the step of circulating the non-reactive gas, or if the measured residual amounts are less than the preset drying reference value, completing the drying operation for the canister, wherein the preset temperature value for starting the first drying operation is in a range of 40 to 70° C., the preset parameter value for the drying operation includes a pumping speed of the pump and a heating value of the heater, the preset parameter value for the drying operation characteristic includes a positive or negative value corresponding to the pumping speed of the pump, and a positive or negative value corresponding to the heating value of the heater, as a parameter for controlling the operation of the pump and the heater corresponding to a parameter of the drying operation; and if the measured residual amounts are more than the preset drying reference value, the pumping speed of the pump is extracted as the negative value, and the heating value of the heater is extracted as the positive value.

4. A method of controlling an apparatus for drying a cavity of a canister loaded with spent nuclear fuel based on evaluation of drying characteristics obtained from the gas spectroscopy, wherein the apparatus includes: the canister having the cavity provided with a gas inlet port and a gas outlet port; a non-reactive gas source which is configured to store non-reactive gas to be supplied to the cavity of the canister; a first gas circulation pump which is mounted on a first gas circulation line which fluidly connects the gas inlet port of the canister and the non-reactive gas source, to feed the non-reactive gas supplied from the non-reactive gas source to the canister; a valve member which is mounted on the first gas circulation line between the first gas circulation pump and the canister to open or dose the first gas circulation line; a heater which is mounted on the first gas circulation line between the valve member and the canister to heat the non-reactive gas to be supplied to the canister; a gas cooling unit which is fluidly coupled to the canister through a second gas circulation line to cool the non-reactive gas discharged from the cavity of the canister; a second gas circulation pump which is mounted on a third gas circulation line to feed the non-reactive gas, which passes through the gas cooling unit, to the non-reactive gas source; a fourth gas circulation line which is branched from the second gas circulation line, to fluidly connect the gas cooling unit and the canister, separately from the second gas circulation line, thereby transferring a contaminated non-reactive gas, which is discharged from the canister, to the gas cooling unit; a branched valve member which is mounted on a branched point, from which the second and fourth gas circulation lines are branched, to selectively open or close the second or fourth gas circulation line; a fifth gas circulation line which is fluidly coupled to the fourth gas circulation line to fluidly connect the gas cooling unit and the non-reactive gas source; a particle filter which is mounted on the fifth gas circulation line to remove radioactive particles contained in the contaminated non-reactive gas which is transferred along the fifth gas circulation line after the non-reactive gas passes through the gas cooling unit along the fourth gas circulation line to be cooled; a third gas circulation pump which is mounted on the fifth gas circulation line to feed the non-reactive gas, which is cooled by the gas cooling unit and is free of the radioactive particles through the particle filter, to the non-reactive gas source: a radiation dosimeter which is installed outside the second gas circulation line between the canister and the branched valve member to measure a radiation dose rate of the non-reactive gas which is discharged from the canister and is transferred along the second gas circulation line, and to send a measured signal; a measuring block which is mounted on the gas outlet port of the canister, and has a transparent window; a gas spectroscopy device which irradiates a transmitted laser onto the non-reactive gas discharged from the canister through the transparent window of the measuring block, and receives scattered light from the non-reactive gas to measure a gas spectroscopy signal which is indicative of components of the non-reactive gas and target components to send measured values; a temperature measuring member which is mounted on the gas outlet port of the canister to measure a temperature inside the canister; a sixth gas circulation line which is fluidly coupled to the second gas circulation line between the canister and the branched valve member and also to the third gas circulation line between the gas cooling unit and the second gas circulation pump, to preliminarily circulate a non-contaminated non-reactive gas along the third gas circulation line together with radioactive substance discharged from the gas outlet port of the canister at preliminary operation; a first valve member which is mounted on the second gas circulation line between the branched point of the second gas circulation line and the branched valve member to close the second gas circulation line, thereby interrupting transfer of the non-reactive gas, which is discharged from the gas outlet port of the canister at the preliminary operation, to the gas cooling unit; second and third valve members which are mounted on both ends of the sixth gas circulation line to open or close the sixth gas circulation line so that the non-reactive gas discharged from the gas outlet port of the canister at the preliminary operation flows along the sixth gas circulation line; a seventh gas circulation line which is branched from the sixth gas circulation line and is fluidly coupled to the fifth gas circulation line between the gas cooling unit and the particle filter, to preliminarily circulate the contaminated non-reactive gas along the fifth gas circulation line together with the radioactive substance discharged from the gas outlet port, of the canister at the preliminary operation; a fourth valve member which is mounted on the seventh gas circulation line to interrupt an end of the seventh gas circulation line at the fifth gas circulation line so that the non-reactive gas transferred from the gas cooling unit along the fifth gas circulation line flows to the seventh gas circulation line; a fifth valve member which is mounted on the third gas circulation line between the gas cooling unit and the branched point of the sixth gas circulation line to interrupt the third gas circulation line so that the non-reactive gas flowing to the third gas circulation line from the sixth gas circulation line at the preliminary operation flows to the gas cooling unit; a sixth valve member which is mounted on the fifth gas circulation line between the gas cooling unit and the branched point of the seventh gas circulation line to interrupt the fifth gas circulation line so that the non-reactive gas flowing to the fifth gas circulation line from the seventh gas circulation line at the preliminary operation flows to the gas cooling unit; a branched valve member which is mounted on a branched point of the sixth and seventh gas circulation lines to selectively open or close the sixth or seventh gas circulation line; a seventh valve member which is mounted on the third gas circulation line between the second gas circulation pump and the non-reactive gas source to interrupt the third gas circulation line so that the non-reactive gas flowing along the third gas circulation line at the preliminary operation flows to the non-reactive gas source; an eighth valve member which is mounted on the fifth gas circulation line between the third gas circulation pump and the non-reactive gas source to interrupt the fifth gas circulation line so that the non-reactive gas flowing along the fifth gas circulation line at the preliminary operation flows to the non-reactive gas source; an eighth gas circulation line which is fluidly coupled to the third gas circulation line between the second gas circulation pump and the seventh valve member and also to the first gas circulation line between the valve member and the heater, to preliminarily circulate the non-contaminated non-reactive gas along the first gas circulation line together with radioactive substance flowing along the third gas circulation line at the preliminary operation; ninth and eleventh valve members which are mounted on both ends of the eighth gas circulation line to open or close the eighth gas circulation line, thereby preventing the non-reactive gas circulating along the first and third gas circulation lines at the drying operation from flowing to the eighth gas circulation line; a ninth gas circulation line which is fluidly coupled to the fifth gas circulation line between the third gas circulation pump and the eighth valve member and also to the eighth gas circulation line between the ninth valve member and the eleventh valve member, to circulate the non-reactive gas, which is flowing along the fifth gas circulation line at the preliminary operation, along the eighth gas circulation line; a tenth valve member which is mounted on an end of the ninth gas circulation line at a side of the fifth gas circulation line to shut off the ninth gas circulation line, thereby preventing the non-reactive gas circulating along the fifth gas circulation line at the drying operation from flowing to the ninth gas circulation line; and a controller which is electrically connected to the first to third gas circulation pumps, the branched valve member, the radiation dosimeter, the gas spectroscopy device, the temperature measuring member, the first to eleventh valve members, the valve member, the second and third gas circulation pumps and the heater, respectively, to determine pollution of the non-reactive gas discharged from the canister based on the measured signal on the radiation dose rate which is received from the radiation dosimeter, and to control an operating state of the branched valve member and the first to third gas circulation pumps according to the determined results and an operating state of the first to eleventh valve members, the valve member, the second and third gas circulation pumps and the heater according to the measured cavity temperature of the canister received from the temperature measuring member and the measured values received from the radiation dosimeter at the preliminary operation, thereby drying the cavity of the canister by selectively circulating the non-reactive gas discharged from the canister through a contaminated circulation system or a non-contaminated circulation system according to a contaminated or non-contaminated state, as well as executing and controlling preliminary operation performed before or in a preparation step and the drying operation according to the measured values received from the gas spectroscopy device and the temperature measuring member, the method comprising:

a step 5000 of setting the dried canister to a gas circulation system so that the non-reactive gas is discharged from a predetermined gas outlet port and is circulated, and inputting a preset temperature value for starting a first drying operation, a preset parameter value for the drying operation, a preset drying reference value, and a preset reference radiation dose rate for determining whether the non-reactive gas is contaminated or not, to prepare the operation;

a step 5100 of feeding the non-reactive gas to the cavity of the canister through the first gas circulation line;

a step 5200 of measuring the temperature of the non-reactive gas discharged from the gas outlet port of the canister by the temperature measuring member after the step of feeding the non-reactive gas is completed, and sending the measured values to the controller;

a step 5300 of determining whether or not the measured temperature of the canister is above the preset temperature value for starting the first drying operation;

if it is determined that the measured temperature of the canister is less than the preset temperature value for starting the first drying operation, a step 5400 of closing the valve member, the first, fifth, sixth, seventh and eighth valve members, opening the second and eleventh valve members, and turning on the heater to preheat the canister;

a step 5500 of measuring the radiation dose rate of the cold non-reactive gas which is discharged from the gas outlet port of the canister and is circulated along the sixth gas circulation line;

if it is determined that the measured temperature of the canister is above the preset temperature value for starting the first drying operation, a step 5510 of measuring the radiation dose rate of the non-reactive gas which is discharged from the gas outlet port of the canister and is circulated along the second gas circulation line;

a step 5600 of determining whether or not the measured radiation dose rate of the cold non-reactive gas is above a reference radiation dose rate;

a step 5610 of determining whether or not the measured radiation dose rate of the non-reactive gas is above the reference radiation dose rate;

if it is determined that the measured radiation dose rate is above the reference radiation dose rate, a contaminated preheat circulation forming step 5700 of opening the branched valve member toward the seventh gas circulation line and opening the fourth and tenth valve members to form a contaminated preheating circulation system consisting of the canister, the seventh, fifth, ninth, eighth and first gas circulation lines;

a contaminated cold non-reactive gas preheating step 5800 of turning on the third gas circulation pump to circulate the contaminated cold non-reactive gas along the contaminated preheating circulation system, thereby raising the cavity temperature of the canister by the preset value for the first drying operation;

if it is determined that the measured radiation dose rate is less than the reference radiation dose rate, a non-contaminated preheat circulation forming step 5900 of opening the branched valve member toward the sixth gas circulation line and opening the third and ninth valve members to form a non-contaminated preheating circulation system consisting of the canister, the sixth, third, eighth first gas circulation lines;

a non-contaminated cold non-reactive gas preheating step 6000 of turning on the third gas circulation pump to circulate the non-contaminated cold non-reactive gas along the non-contaminated preliminary circulation system, so that the cavity temperature of the canister raises up to the preset temperature value for starting the first drying operation;

a step 6100 of measuring the temperature of the non-reactive gas discharged from the gas outlet port of the canister to measure the cavity temperature of the canister while preheating the contaminated cold non-reactive gas;

a step 6200 of measuring the temperature of the non-reactive gas discharged from the gas outlet port of the canister to measure the cavity temperature of the canister while preheating the non-contaminated non-reactive gas;

a step 6300 of determining whether or not the measured cavity temperature of the canister reaches the preset temperature value for starting the first drying operation, and if the measured cavity temperature of the canister does not reach the preset temperature value for starting the first drying operation, proceeding to the contaminated cold non-reactive gas preheating step;

if it is determined that the measured cavity temperature of the canister is more than the preset temperature value for starting the first drying operation or if it is determined that the measured radiation dose rate of the non-reactive gas is above the reference radiation dose rate, a step 6400 of opening the branched valve member toward the fourth gas circulation line, opening the valve member, the first, sixth, and eighth valve members, and closing the second, fourth, tenth and eleventh valve members to form a normal contaminated drying circulation system consisting of the canister, the fourth gas circulation line, the gas cooling unit, the fifth gas circulation line, the non-reactive gas source and the first gas circulation line;

a step 6500 of turning on the first and third gas circulation pumps and the gas cooling unit to circulate the contaminated non-reactive gas along the normal contaminated circulation system, based on the preset parameter value for the drying operation thereby drying the cavity of the canister;

a step 6600 of determining whether or not the measured cavity temperature of the canister reaches the preset temperature value, and if the measured cavity temperature of the canister does not reach the preset temperature value, proceeding to the non-contaminated cold non-reactive vas preheating step;

if it is determined that the measured cavity temperature of the canister is more than the preset temperature value or if it is determined that the measured radiation dose rate of the non-reactive gas is less than the reference radiation dose rate, a step 6700 of opening the branched valve member toward the second gas circulation line, opening the valve member, the first, fifth and seventh valve members, and closing the second, third, ninth and eleventh valve members to form a normal non-contaminated drying circulation system consisting of the canister, the second gas circulation line, the gas cooling unit, the third gas circulation line, the non-reactive gas source and the first gas circulation line;

a step 6800 of turning on the first and second gas circulation pumps and the gas cooling unit to circulate the non-contaminated non-reactive gas along the normal non-contaminated circulation system based on the preset parameter value, thereby drying the non-contaminated cavity of the canister;

a measuring step 6900 of measuring a target component of the non-reactive gas discharged from the gas outlet port and residual amounts of the target component with the gas spectroscopy device which is mounted on the gas outlet port of the canister;

a step 7000 of comparing the measured residual amounts of the target component with the preset drying reference value, to determine whether or not the measured residual amounts are less than the preset drying reference value;

if it is determined that the measured residual amounts are above the preset drying reference value, a computing step 7100 of computing a parameter for drying operation characteristic corresponding to the measured residual amounts to extract a preset parameter value for the drying operation characteristic;

a step 7200 of inputting the preset parameter value for the drying operation characteristic to control the operation of the gas circulation system in order for applying the preset parameter value for the drying operation characteristic, which is extracted from the step, to the drying operation, and then proceeding to the measuring step;

if it is determined that the measured residual amounts are less than the preset drying reference value, a step of counting a preset time;

if the preset time expires, a secondary measuring step of measuring the target component of the non-reactive gas discharged from the gas outlet port and residual amounts of the target component with the gas spectroscopy device which is mounted on the gas outlet port of the canister;

a step of comparing the measured residual amounts of the target component, which is measured at the secondary measuring step, with the preset drying reference value, to determine whether or not the measured residual amounts are less than the preset drying reference value, and if the measured residual amounts are more than the preset drying reference value, proceeding to the computing step, or if the measured residual amounts are below the preset drying reference value, completing the drying operation for the canister, wherein the preset temperature value for starting the first drying operation is in a range of 40 to 70° C., the preset parameter value for the drying operation includes a pumping speed of the pump and a heating value of the heater, the preset parameter value for the drying operation characteristic includes a positive or negative value corresponding to the pumping speed of the pump, and a positive or negative value corresponding to the heating value of the heater, as a parameter for controlling the operation of the pump and the heater corresponding to a parameter of the drying operation, and if the measured residual amounts are more than the preset drying reference value, at the step, the pumping speed of the pump is extracted as the negative value, and the heating value of the heater is extracted as the positive value.

* * * * *